US005854965A

United States Patent [19]

Kasiwabara et al.

[11] Patent Number: 5,854,965

[45] **Date of Patent: *Dec. 29, 1998**

[54] DUPLEX IMAGE FORMING APPARATUS WITH FRONT SURFACE UP DISCHARGE CONTROL

[75] Inventors: Akihiro Kasiwabara, Tokyo; Mitsuhiro Mukasa, Kawasaki, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 870,592

[22] Filed: Jun. 6, 1997

Related U.S. Application Data

[63] Continuation of Ser. No. 598,282, Feb. 8, 1996, abandoned, which is a continuation of Ser. No. 167,142, Dec. 16, 1993, abandoned.

[30] Foreign Application Priority Data

| | | | |
|---|---|---|---|
| Dec. 18, 1992 | [JP] | Japan | 4-355745 |
| Oct. 25, 1993 | [JP] | Japan | 5-289878 |
| Oct. 25, 1993 | [JP] | Japan | 5-289879 |
| Oct. 29, 1993 | [JP] | Japan | 5-272118 |

[51] Int. Cl.[6] ..... G03G 15/00

[52] U.S. Cl. ..... 399/381; 399/110; 399/401

[58] Field of Search ..... 399/361, 364, 399/381, 388, 391, 401, 110, 124; 271/184, 186, 9, 3.1; 355/205, 206, 207, 208, 308, 309, 317, 318, 319, 321, 322

[56] References Cited

U.S. PATENT DOCUMENTS

| | | |
|---|---|---|
| 3,689,146 | 9/1972 | Ito et al. . |
| 4,116,556 | 9/1978 | Tanaka et al. . |
| 4,692,020 | 9/1987 | Tsujihara . |
| 4,721,381 | 1/1988 | Matsuo . |
| 4,864,368 | 9/1989 | Muramatsu . |
| 4,878,087 | 10/1989 | Sakai et al. . |
| 4,954,849 | 9/1990 | Koike et al. . |
| 4,956,678 | 9/1990 | Kiya et al. . |
| 4,990,965 | 2/1991 | Kiya . |
| 4,992,831 | 2/1991 | Kunishi . |
| 5,045,881 | 9/1991 | Kinder et al. . |
| 5,206,689 | 4/1993 | Kusuda . |
| 5,258,817 | 11/1993 | Sundquist et al. . |
| 5,327,207 | 7/1994 | Otake et al. . |

FOREIGN PATENT DOCUMENTS

| | | |
|---|---|---|
| 3612590 | 4/1986 | Germany . |
| 3818982 | 6/1988 | Germany . |

*Primary Examiner*—Sandra L. Brase

*Attorney, Agent, or Firm*—Fitzpatrick, Cella, Harper & Scinto

[57] ABSTRACT

The present invention provides an image forming apparatus with an image forming device, sheet containers, sheet discharge unit for discharging the sheet on which the image was formed onto the stacking tray, convey path for directing the sheet to the image forming device, switching unit for selectively directing the sheet to the discharge unit or the convey path and for directing the sheet from the convey path to the discharge unit, and convey rollers for conveying the sheet along the convey path means toward a direction extending from the switching unit to the image forming device or an opposite direction.

25 Claims, 36 Drawing Sheets

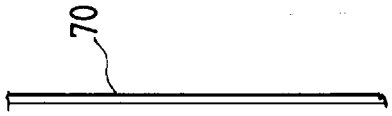
FIG. 16
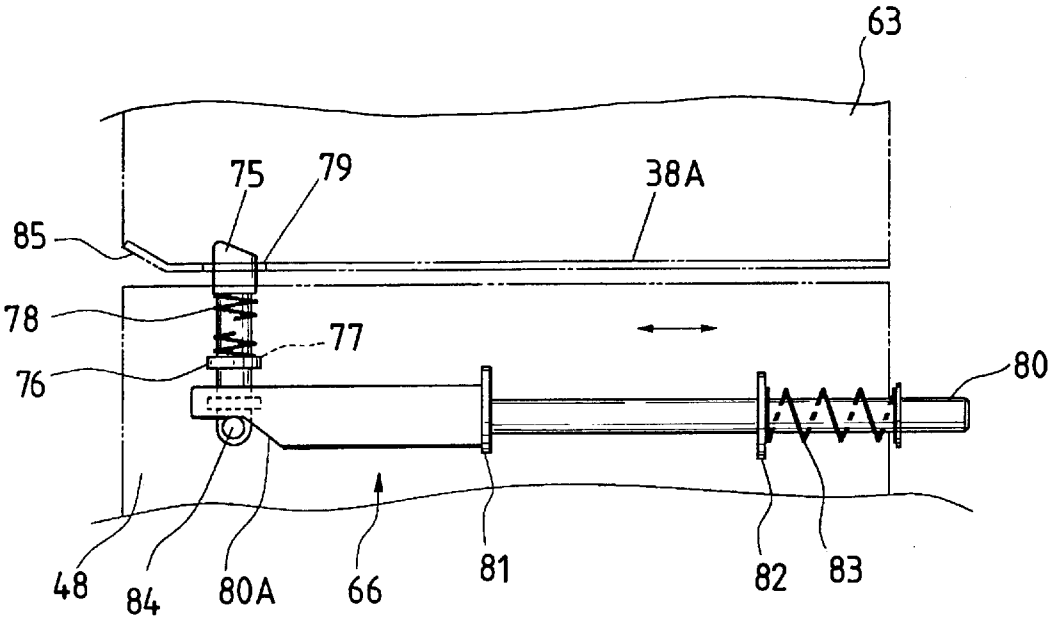

DUPLEX IMAGE FORMING APPARATUS WITH FRONT SURFACE UP DISCHARGE CONTROL

This application is a continuation of application Ser. No. 08/598,282, filed Feb. 8, 1996, now abandoned, which is a continuation of application Ser. No. 08/167,142, filed Dec. 16, 1993, now abandoned.

BACKGROUND OF THE INVENTION

1. Field of the Invention

The present invention relates to an image forming apparatus such as a copying machine, a printer, a facsimile machine and the like.

2. Related Background Art

In the past, as shown in FIG. 37, in a first conventional image forming apparatus such as a copying machine, a printer, a facsimile machine and the like, a fixing device 803 for fixing a toner image (formed on a photosensitive drum 802) transferred to a sheet by a transfer charger 801 onto a surface of the sheet, a pair of discharge rollers 805 for discharging the sheet to which the image was fixed by the fixing device 803 out of the image forming apparatus, and a reverse rotation portion 806 for reversing or inverting the sheet to which the image was fixed by the fixing device 803 and the like are fixed to a body 804 of the image forming apparatus. Further, a both-face unit 808 including an intermediate tray 807 for temporarily storing the sheets on which the images were formed and for sending each sheet to the photosensitive drum 802 again is designed so that it can be retracted out of the image forming apparatus from a front side of the body 804 of the image forming apparatus.

In such a conventional image forming apparatus, if the sheet is jammed in the fixing device 803, the paired discharge rollers 805 or the reverse rotation portion 806, as shown in FIG. 38, a sorter 809 is separated from the body 804 of the image forming apparatus (by shifting it in a direction shown by the arrow A) and an openable side cover 811 is opened by rocking it around a support shaft 810 so that the sheet jammed in the fixing device 803, the paired discharge rollers 805 or the reverse portion 806 can be removed. Further, if the sheet is jammed in the both-face unit 808, the unit is retracted out of the body 804 of the image forming apparatus so that the sheet jammed in the both-face unit 808 can be removed.

In a second conventional image forming apparatus such as a copying machine, a printer, a facsimile machine and the like, in order to facilitate the jam treatment, main elements incorporated into a body of the image forming apparatus are grouped as a unit so that the unit can be retracted out of the image forming apparatus from a front side of the body of the image forming apparatus. For example, a fixing unit including a fixing device for fixing a transferred toner image onto a surface of the sheet, and a both-face unit including an intermediate tray for temporarily storing the sheets on which the images were formed and for supplying each sheet again can be retracted out of the image forming apparatus.

Accordingly, when the fixing unit and the both-face unit are retracted from the image forming apparatus, the sheet jammed in the fixing unit or the both-face unit can easily be removed. In this case, in the conventional copying machines, the fixing unit and the both-face unit are retracted from the image forming apparatus individually and are re-inserted into the image forming apparatus individually.

In the single-face or one-face image formation, after an image is formed on a sheet supplied from a sheet stacking portion 802A in the image forming portion 802 and the image is fixed to the sheet in the fixing portion 803, the sheet is discharged from the image forming apparatus by the pair of the discharge rollers 805. On the other hand, in the both-face image formation, the sheet is reversed by a both-face flapper 855 disposed at a downstream side of the fixing portion 803 to direct the sheet to a pair of reverse rotation rollers 806, and then the sheet is directed to a pair of rollers 880 by a reverse rotation flapper 856. Then, the sheet is stored on a both-face tray 807 by pairs of rollers 881, 882, 883. Thereafter, the sheets stored on the tray are supplied to the image forming portion 802 one by one by a sheet re-supply means 858 and an image is formed on a back surface of the sheet. Further, in the multi-copying operation, the sheet is directed to a reverse rotation convey path 859 by the both-face flapper 855 and the reverse rotation flapper 856. After a trailing end of the sheet has passed through the reverse rotation flapper 856, a pair of multi reverse rotation rollers 860 are reversely rotated so that the sheet is directed to the pair of rollers 880 by the reverse rotation flapper 856 to accommodate the sheet in the both-face tray 857. Then, the sheet is re-supplied to the image forming portion. Further, in the case where a CFF (computer format sheets) is copied from its rear page, when the sheets are stacked with the copied surface thereof facing upside (face-up), copies can be obtained in an order same as the page order of the originals. However, when the originals are copied from the front page, unless the sheets are reversed and then stacked (face-down), the copies cannot be obtained in the order same as the page order of the originals. In this case, each sheet is directed to the reverse rotation convey path 806 by the both-face flapper 855 and the reverse rotation flapper 856, and, after the trailing end of the sheet has passed through the both-face flapper 855, the pair of reverse rotation rollers 861 and the pair of multi reverse rotation rollers 860 are reversely rotated so that the sheet is directed to the pair of sheet discharge rollers 805 by the flapper 855, thereby discharging the sheet.

However, as in the aforementioned first conventional image forming apparatus, when the sheet jammed in the fixing device 803, the discharge rollers 805 or the reverse rotation portion 806 is removed (jam treatment) by opening the cover 811 disposed at the sheet discharge side, since a space for opening the discharge side cover 811 is required, the substantial installation space for the image forming apparatus is increased.

An object of the present invention is to provide an image forming apparatus in which the substantial installation space for the image forming apparatus is not increased while permitting the jam treatment.

On the other hand, as in the aforementioned second conventional image forming apparatus, when the units (fixing unit and both-face unit) are retracted and inserted individually with respect to the image forming apparatus, the jam treatment is very troublesome.

Another object of the present invention is to provide an image forming apparatus wherein the jam treatment can easily by performed when a plurality of units are retracted from the image forming apparatus.

Incidentally, in the conventional image forming apparatuses 804, since the reverse rotation convey path 859 for reversing the sheet is constructed independently, if the sheet is jammed in the reverse rotation convey path 859, the jammed sheet must be also removed from the reverse rotation convey path, and, thus, the jam treatment is troublesome. Recently, many conventional image forming apparatuses have been designed so that, if the sheet is jammed, the sheet is removed after the units are retracted out of the image forming apparatus in front of the apparatus. In the conventional image forming apparatuses, as shown in FIG. 38, the sorter 809 is separated from the body 804 of the image forming apparatus, the openable discharge side cover 811 is opened around the support shaft 810 and then the jammed sheet is removed from the fixing device 803, the paired discharge rollers 805 or the reverse rotation portion 806. Therefore, the construction of the image forming apparatus was complicated. Further, since there is the independent reverse rotation convey path, the apparatus was expensive. The present invention is created in consideration of such disadvantages.

SUMMARY OF THE INVENTION

According to a first aspect of the present invention, there is provided an image forming apparatus comprising a fixing means for fixing an image formed on a sheet to a surface of the sheet, a discharge means for discharging the sheet to which the image was fixed out of the image forming apparatus, and a reverse rotation means for reversing the sheet to which the image was fixed. Wherein a part unit is constituted by the fixing means, discharge means and reverse rotation means, and the part unit can be retracted out of the image forming apparatus from its front side.

Thus, in accordance with the first aspect, since the part unit including the fixing means, discharge means and reverse rotation means can be retracted out of the image forming apparatus from its front side, if the sheet is jammed in the fixing means, discharge means or reverse rotation means, the jammed sheet can be removed by retracting the part unit out of the image forming apparatus. Accordingly, the image forming apparatus does not need a space for removing the sheet jammed in the fixing means, discharge means or reverse rotation means, thereby reducing the installation space for the image forming apparatus.

According to a second aspect of the present invention, there is provided an image forming apparatus comprising a fixing means for fixing an image formed on a sheet to a surface of the sheet, and a discharge means for discharging the sheet to which the image was fixed out of the image forming apparatus. Wherein a part unit is constituted by the fixing means and the discharge means, and the part unit can be retracted out of the image forming apparatus from its front side.

Thus, in accordance with the second aspect, since the part unit including the fixing means and the discharge means can be retracted out of the image forming apparatus from its front side, if the sheet is jammed in the fixing means or the discharge means, the jammed sheet can be removed by retracting the part unit out of the image forming apparatus. Accordingly, the image forming apparatus does not need a space for removing the sheet jammed in the fixing means or the discharge means, thereby reducing the installation space for the image forming apparatus.

According to a third aspect of the present invention, there is provided an image forming apparatus comprising a plurality of part units retractable out of the image forming apparatus. Wherein the part units are integrally connected to each other by a unit lock means.

In accordance with the third aspect, when the plurality of part units are retracted out of the image forming apparatus, the part units retracted from the image forming apparatus are integrally connected to each other by the unit lock means. On the other hand, when the plurality of part units are accommodated into the image forming apparatus, the unit lock means is released and the units are locked to a body of the image forming apparatus by a body lock means. Accordingly, by inserting one of the part units retracted out of the image forming apparatus into the image forming apparatus, the other units can also be inserted into the image forming apparatus at a time. Thus, after the jam treatment, the plurality of part units can easily be accommodated into the image forming apparatus. According to a fourth aspect of the present invention, there is provided an image forming apparatus comprising a lock releasing means for releasing a locking condition of the unit lock means, and a sheet detection means for detecting the presence/absence of the sheet jammed in the part units. Wherein, when the sheet detection means detects the fact that the sheet is not jammed in either of the part units integrally connected to each other by the unit lock means, the locking condition of the unit lock means is released by the lock releasing means.

With this arrangement, since the plurality of part units accommodated in the image forming apparatus are integrally connected to each other by the unit lock means, when the part units are retracted out of the image forming apparatus and when the part units are inserted into the image forming apparatus, such part units are operated in a body. When the sheet detection means detects the fact that the sheet is not jammed in either of the part units interlocked by the unit lock means, the unit lock means is released by the lock releasing means so that the part units in which the sheet is not jammed are separated from the part unit in which the sheet is jammed. Accordingly, by retracting the single part unit out of the image forming apparatus, the other part units can also be retracted out of the image forming apparatus at a time, and, by inserting the single part unit into the image forming apparatus, the other part units can also be inserted into the image forming apparatus at a time. Thus, after the jam treatment, the plurality of part units can easily be accommodated into the image forming apparatus.

According to a fifth aspect of the present invention, there is provided an image forming apparatus comprising an image forming means for forming an image on a sheet, a stacking means on which the sheets are stacked, a discharge means for discharging the sheet on which the image was formed by the image forming means, a convey path means for directing the sheet on which the image was formed by the image forming means to the image forming means, a switching means for selectively directing the sheet on which the image was formed by the image forming means to the discharge means or the convey path means and for directing the sheet from the convey path means to the discharge means, and a convey means for conveying the sheet along the convey path means toward a direction extending from the switching means to the image forming means or toward a reverse direction.

In this arrangement, since the plurality of part units are integrally retracted from the image forming apparatus, the sheet straddling between the part units is not damaged at all.

Further, since the part units in which the sheet is not jammed can be separated from the part unit in which the sheet is jammed, only the part unit in which the sheet is jammed can be retracted from the image forming apparatus.

BRIEF DESCRIPTION OF THE DRAWINGS

FIGS. 16 to 21 are explanatory views showing a locking mechanism for locking a fixing unit and a both-face unit according to the embodiment of FIG. 14;

DETAILED DESCRIPTION OF THE PREFERRED EMBODIMENTS

First, second and third invention will now be explained in connection with embodiment thereof with reference to the accompanying drawings.

Figure 1:
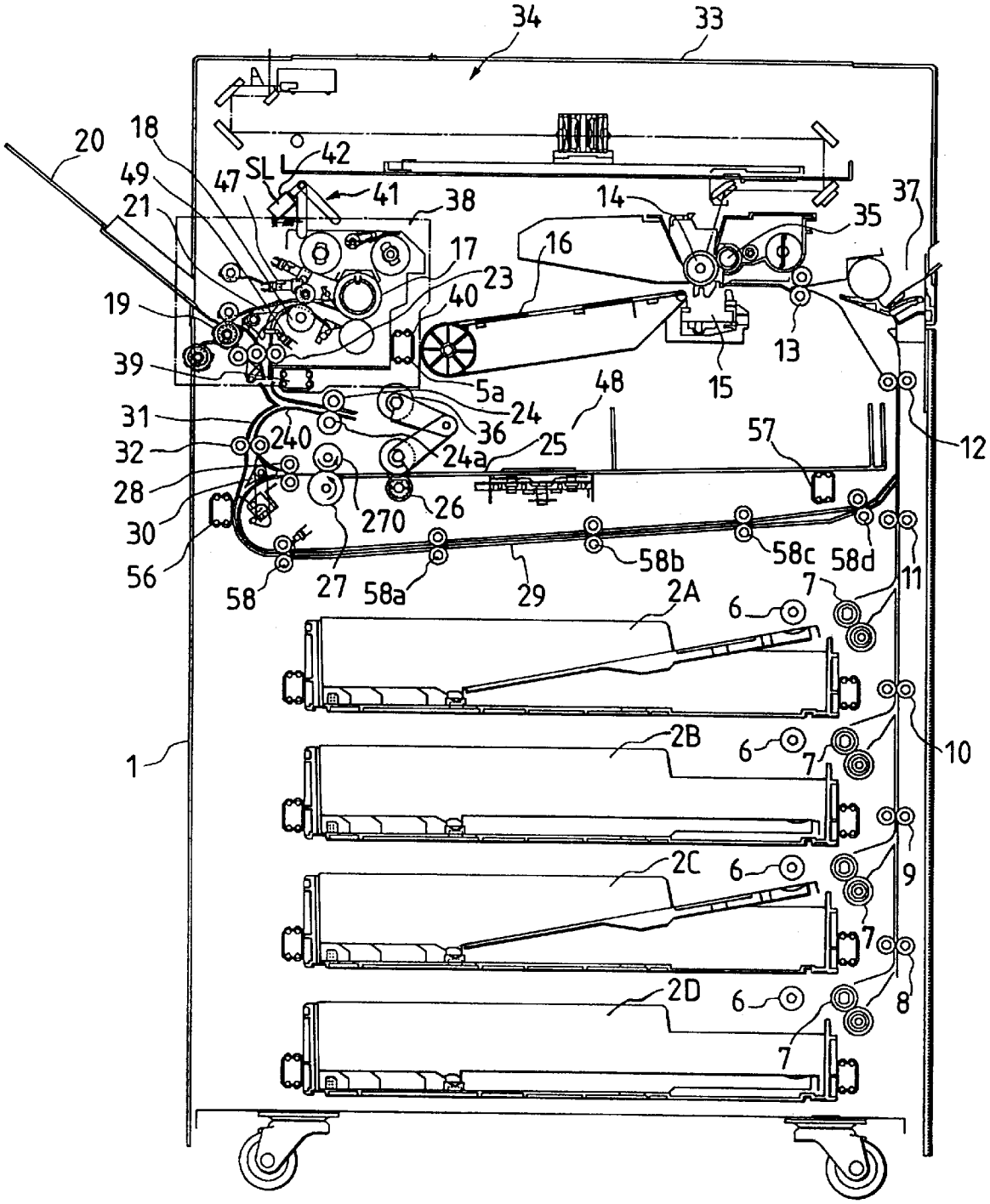
FIG. 1 is a sectional view showing a first embodiment (image forming apparatus) according to a first invention.
Figure 2:
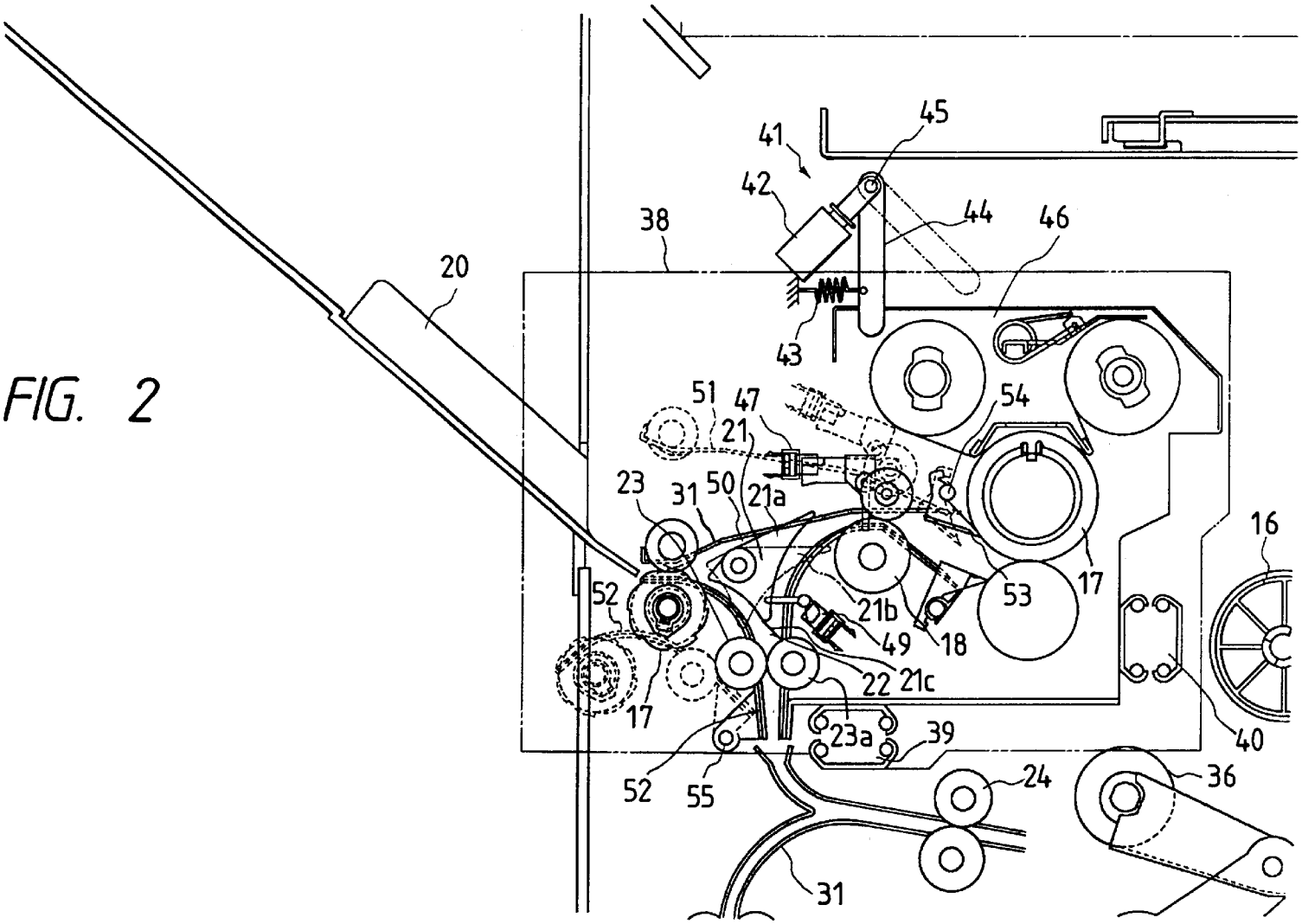
FIG. 2 is an explanatory view showing main portions of the apparatus of FIG. 1 in detail.

FIG. 1 shows the whole construction of an image forming apparatus (copying machine) according to a first embodiment of a first invention, and FIG. 2 shows main portions of the image forming apparatus.

First of all, the whole construction of the image forming apparatus will be briefly explained along a flow of a sheet.

In this image forming apparatus, a plurality of sheet supply cassettes (front loading cassettes) 2A, 2B, 2C and 2D are provided at a lower portion of the image forming apparatus 1 in an overlapped condition so that sheets (not shown) stacked in these sheet supply cassettes can selectively be used. The sheets in the sheet supply cassettes 2A, 2B, 2C and 2D are fed out by corresponding sheet supply rollers (pick-up rollers) 6 and are separated one by one by corresponding pair of separation rollers (pair of retard rollers) 7.

The sheet supplied from the sheet supply cassette 2A, 2B, 2C or 2D is conveyed to a pair of regist rollers 13 (now stopped) by a pair of convey rollers 8, 9, 10 or 11 and a pair of convey rollers 12. Then, the sheet is sent to a transfer station between a photosensitive drum 14 rotated in a clockwise direction and a transfer device 15 by the pair of regist rollers 13 which are rotated in registration with a toner image formed on the photosensitive drum 14. In the transfer station, the toner image formed on the photosensitive drum 14 is transferred onto the sheet by the transfer device 15.

The sheet to which the toner image was transferred is sent, by a convey belt 16, to a fixing device (fixing means) 17, where the transferred toner image is fixed to the sheet. Thereafter, the sheet is discharged onto a sheet discharge tray 20 disposed outside the apparatus, by a pair of inner discharge rollers (discharge means) 18 and a pair of outer discharge rollers (discharge means) 19. In this case, a flapper 21 disposed between the inner discharge rollers 18 and the outer discharge rollers 19 is switched to a position shown by the phantom line (FIG. 2).

In the both-face mode or the multi mode, the sheet to which the toner image was fixed is sent, by the inner discharge rollers 18, to a reverse rotation path (reverse rotation means) 22, where the sheet is reversed. Then, the sheet is discharged onto an intermediate tray 25 by pairs of convey rollers 23, 24. In this case, the flapper 21 is switched to a position shown by the solid line.

The sheets temporarily stored on the intermediate tray 25 are fed out from the lowermost one by a sheet supply roller 26 and are separated one by one by a pair of separation rollers 27 rotated in directions shown by the arrows.

In the both-face mode, the sheet re-supplied from the intermediate tray 25 is sent to a re-supply path 29 and then is sent from the re-supply path 29 to the pair of regist rollers 13. In this case, a flapper 30 disposed immediately below the pair of convey rollers 28 is switched to a position shown in FIG. 1.

In the multi mode, the sheet re-supplied from the intermediate tray 25 is once sent to a re-reverse rotation path 31 by the pair of convey rollers 28 and the flapper 30. After the sheet is reversed, the sheet is sent to the re-supply path 29 by a pair of convey rollers 32 reversely rotated, and then is sent from the re-supply path 29 to the pair of regist rollers 13. In this case, the flapper 30 is switched so that the sheet is sent to the re-supply path 29.

Similar to the above-mentioned case, a toner image is transferred onto the sheet sent from the paired regist rollers 13 and then the toner image is fixed to the sheet. Thereafter, the sheet is discharged onto the discharge tray 20 disposed outside the image forming apparatus by the pairs of inner and outer discharge rollers 18, 19.

In this image forming apparatus, an image on an original (not shown) rested on an original support 33 is scanned by an optical system 34 arranged in the image forming apparatus at its uppermost portion, thereby exposing the photosensitive drum 14 rotated in the clockwise direction by the image light reflected from the original. A latent image formed on the photosensitive drum 14 is developed by toner supplied from a developing device 35 as the toner image.

Incidentally, in FIG. 1, the reference numeral 36 denotes a pressure roller for urging the sheets stacked on the intermediate tray 25 against the sheet supply roller 26, which pressure roller is lowered to a position shown in FIG. 1 when the sheet is re-supplied. The reference numeral 37 denotes a manual sheet supply (insertion) device.

In the image forming apparatus, the fixing device 17, the pair of inner discharge rollers 18, the pair of outer discharge rollers 19, the flapper 21 and the reverse rotation path 22 including the pair of convey rollers 23 are integrally incorporated as a part unit 38 which can be retracted out of the image forming apparatus 1 at its front side.

The part unit 38 is mounted to the image forming apparatus via shift rails 39, 40 so that the part unit can be retracted along these rails. The part unit 38 is locked by a lock mechanism 41 so that the part unit cannot be retracted from the image forming apparatus.

In the lock mechanism 41, when a solenoid 42 is turned OFF, a lock lever 44 biased by a tension spring 43 is rotated around a support pin 45 in a clockwise direction to reach a position a, thereby engaging with a frame 46 of the part unit 38 to lock the part unit 38. On the other hand, when the solenoid 42 is turned ON, the lock lever 44 biased by the tension spring 43 is rotated around the support pin 45 in an anti-clockwise direction to reach a position b, thereby disengaging from the frame 46 of the part unit 38 to unlock or release the part unit 38.

In the part unit 38, there is provided a sheet detection sensor 47 for detecting the jammed sheet straddling between the part unit 38 and the convey belt 16 and between the part unit 38 and the discharge tray 20, and a sheet detection sensor 49 for detecting the jammed sheet straddling between the part unit 38 and the both-face unit 48.

In the single-face mode, if the sheet is jammed while straddling between the part unit 38 and the convey belt 16 or between the part unit 38 and the discharge tray 20 and such jammed sheet is detected by the sheet detection sensor 47, the solenoid 42 of the lock mechanism 41 is maintained in the ON condition so that the part unit 38 cannot be retracted from the image forming apparatus. In this condition, the fixing device (pair of fixing rollers) 17, the pair of inner discharge rollers 18 and the pair of outer discharge rollers 19 are driven to positively discharge the jammed sheet onto the discharge tray 20. Thereafter, the solenoid 42 of the lock mechanism 41 is turned OFF, thereby releasing a locking condition of the part unit 38.

On the other hand, in the both-face mode and multi mode, if the sheet is jammed while straddling between the part unit 38 and the both-face unit 48 and the jammed sheet is detected by the sheet detection sensor 49, the solenoid 42 of the lock mechanism 41 is maintained in the ON condition so that the part unit 38 cannot be retracted from the image forming apparatus. In this condition, the fixing device (pair of fixing rollers) 17, the pair of inner discharge rollers 18 and the pairs of convey rollers 23, 24 are driven to positively discharge the jammed sheet onto the intermediate tray 25. Thereafter, the solenoid 42 of the lock mechanism 41 is turned OFF, thereby releasing a locking condition of the part unit 38.

When the locking condition of the lock mechanism 41 is released, the part unit 38 can be retracted out of the image forming apparatus. The sheet jammed in the part unit 38 retracted out of the image forming apparatus 1 can easily be removed by opening an upper guide 51 of a sheet discharge path 50 and an outer guide 52 of the reverse rotation path 22. The upper guide 51 of the sheet discharge path 50 is pivotally mounted on a support pin 54 of a separating claw 53 of the fixing device 17 for pivotal movement around the support pin 54 in an up-and-down direction. Accordingly, when the upper guide 51 is rotated upwardly to a position shown by the broken line, the sheet discharge path 50 is opened. By the rotation of the upper guide 51, the separating claw 53 is separated from the fixing roller.

The outer guide 52 of the reverse rotation path 22 is rotatably mounted on the image forming apparatus 1 via a support pin 55 for rotational movement in a left and right direction. Accordingly, when the outer guide 52 is rotated outwardly (to the left) to a position shown by the broken line, the reverse rotation path 22 is opened.

Similar to the part unit 38, the both-face unit 48 integrally including the intermediate tray 25, the pair of separation rollers 27, the re-reverse rotation path 31 and the re-supply path 29 can be retracted out of the image forming apparatus 1 at its front side. The both-face unit 48 is mounted to the image forming apparatus 1 via shift rails 56, 57 so that the unit can be retracted along these rails.

In the both-face unit 48 retracted out of the image forming apparatus 1, the sheet jammed in the re-supply path 29 can easily be removed by inclining the re-supply path 29 from a substantially horizontal condition to a substantially vertical condition. The re-supply path 29 is rotatably mounted around a roller shaft of one of paired convey rollers 58 for pivotal movement in an up-and-down direction. Accordingly, the re-supply path 29 can be inclined around the roller shaft from a substantially horizontal condition to a substantially vertical condition.

Figure 3:
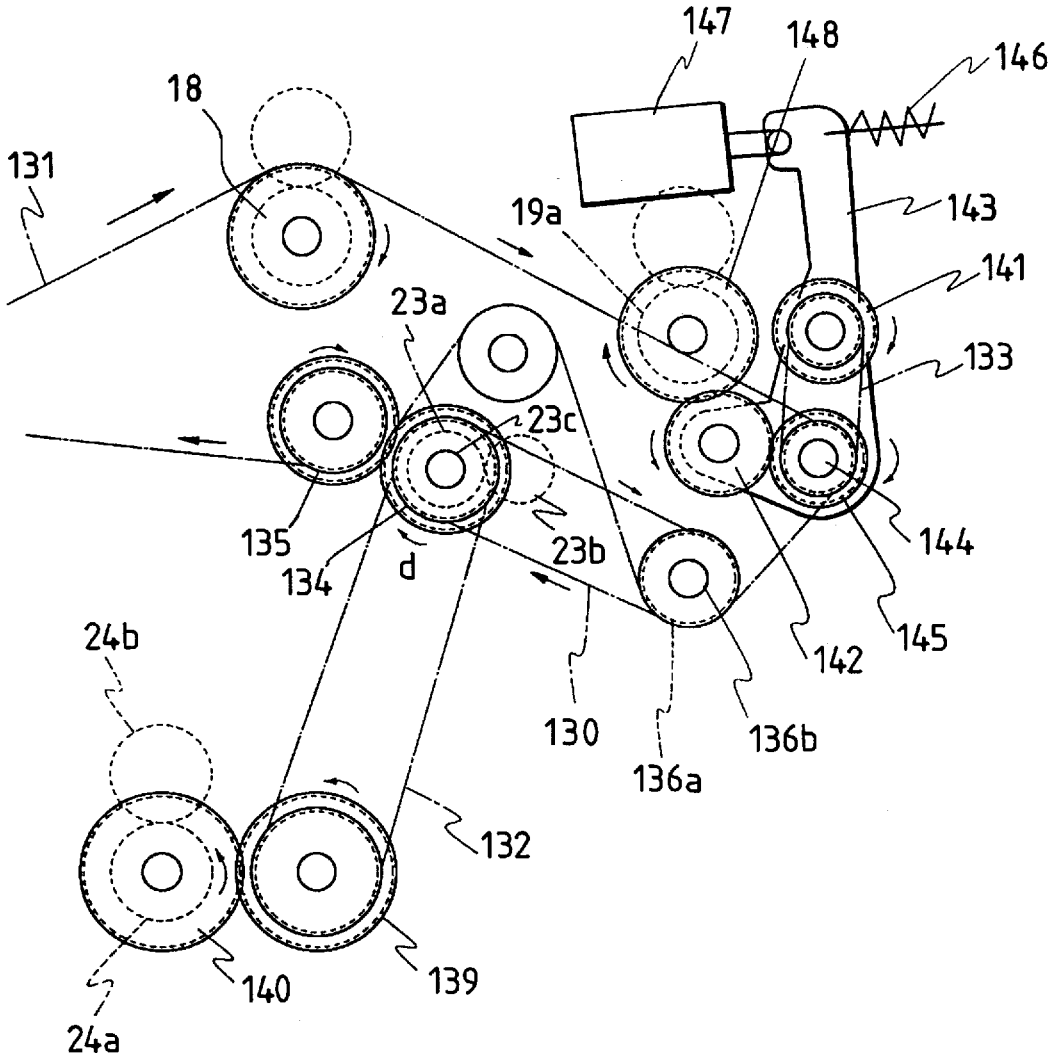
FIG. 3 is an explanatory view showing a drive system according to another embodiment of the first invention.
Figure 4:
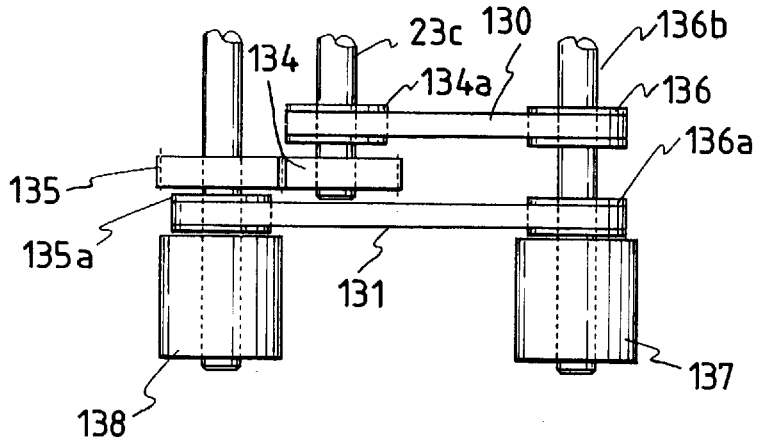
FIG. 4 is an explanatory view showing a main portion of FIG. 3.

FIG. 3 is a view showing a drive system for driving the paired convey rollers disposed at a downstream side of the fixing device 17, and FIG. 4 is a plan view of a drive system for the pair of both-face reverse rotation rollers 23.

A roller 23a which is one of the pair of both-face reverse rotation rollers 23 is subjected to a driving force from a gear 134 or a timing belt 130. A gear 135 and a timing pulley 136 for driving the both-face reverse rotation roller 23*a* is subjected to a driving force from a timing belt 131 for driving the fixing convey roller 5 via a normal rotation electromagnetic clutch 137 or a reverse rotation electromagnetic clutch 138. Thus, unless the normal rotation electromagnetic clutch 137 or the reverse rotation electromagnetic clutch 138 is operated, the driving force is not transmitted to the both-face reverse rotation rollers 23.

Since the timing belt 131 is rotated in a direction shown by the arrow, when the both-face reverse rotation roller 23*a* is rotated in a direction (shown by the arrow d) so that the sheet is conveyed toward the both-face tray 25, the normal rotation electromagnetic clutch 137 is operated and the reverse rotation electromagnetic clutch 138 is not operated, with the result that the driving force from the timing belt 131 is transmitted via a pulley 136*a*, the normal rotation electromagnetic clutch 137, a shaft 136*b*, the pulley 136, the timing belt 130 and the pulley 134, thereby driving the both-face reverse rotation roller 23*a*. On the other hand, when the sheet is to be reversed, the reverse rotation electromagnetic clutch 138 is operated and the normal rotation electromagnetic clutch 137 is not operated, with the result that the driving force from the timing belt 131 is transmitted via a pulley 135*a*, the reverse rotation electromagnetic clutch 138, the gears 134, 135 and a shaft 23*c*, thereby driving the both-face reverse rotation roller 23*a*. Since there is the drive connection between the both-face reverse rotation roller 23*a* and a both-face sheet discharge roller 24*a* via a timing belt 132 and gears 139, 140, the both-face reverse rotation roller 23*a* and the both-face sheet discharge roller 24*a* are rotated in the same direction.

Further, a discharge roller 19*a* is so designed to selectively receive a driving force from a gear 141 or 142, and these two gears are mounted on a rock plate 143 pivotally rotated around a shaft 144. Further, since the two gears 141, 142 are driven by a gear 145 and a timing belt 133, these gears are rotated in reverse directions from each other. Further, since the gear 142 mounted on the rock plate 143 is always biased against a gear 148 of the discharge roller 22 by a spring 146, the discharge roller 19 is subjected to a driving force for discharging the sheet out of the image forming apparatus. When the discharge roller 19 is desired to be rotated reversely, a sheet discharge reverse rotation solenoid 147 is operated, thereby engaging the gear 141 with the gear 148 of the discharge roller 19 to drive the discharge roller 19.

Figure 5:
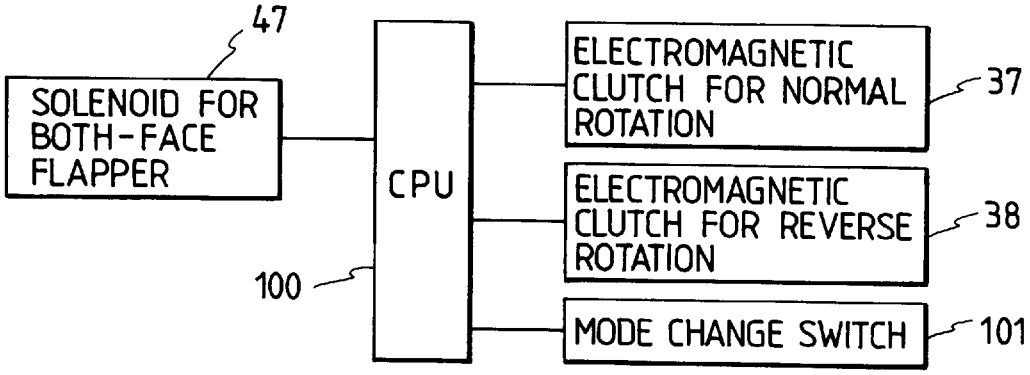
FIG. 5 is a control block diagram associated with the first invention.

With the arrangement as mentioned above, in the case where the sheet is reversed and then is discharged, when a reverse rotation discharge mode is selected by a mode change switch 101 shown in FIG. 5, a CPU 100 operates to shift the both-face flapper 21 to the position 21*a* by the solenoid 47 so that the sheet is sent to the both-face convey path 22. When a trailing end of the sheet passes through the reverse rotation sensor 49 (FIG. 6), the reverse rotation electromagnetic clutch 138 is turned ON and the normal rotation electromagnetic clutch 137 is turned OFF, thereby rotating the pair of reverse rotation rollers 23 and the pair of both-face discharge rollers 24 reversely. Consequently, the sheet is guided to the discharge roller 19 by a flapper 21*c* attached to the flapper 21 (FIG. 7).

On the other hand, in the multi mode, the both-face flapper 21 is shifted to the position 21*b* to send the sheet on which the image was formed to the pair of discharge rollers 19. When the fixing sensor 47 detects the fact that the trailing end of the sheet passes through the both-face flapper 21, the both-face flapper 21 is returned to the position 21*a* and at the same time the reverse rotation discharge solenoid 147 is operated, thereby rotating the discharge rollers 19 reversely. As a result, the sheet is conveyed while being guided along the both-face convey path 22 so that the sheet is rested on the both-face tray 25 by the pair of both-face reverse rotation rollers 23. The sheets stacked on the tray 25 are fed out by the feed-out roller 27 and are separated one by one. The separated sheet is sent to the photosensitive drum 14 by pairs of convey rollers 28, 58, 58*a*, 58*b*, 58*c* and 58*d*, so that a new image is formed on the same surface of the sheet as the surface on which the image was previously formed.

In the both-face mode, the flapper 21 is shifted to the position 21*a*, and the sheet on which the image was formed is guided to the both-face convey path 22. Then, the sheet is conveyed by the pair of both-face reverse rotation rollers 23 and the pair of both-face discharge rollers 24 to be discharged onto the both-face tray 25. The sheets stacked on the tray 25 are fed out by the feed-out roller 27 and are separated one by one. The separated sheet is sent to the photosensitive drum 14 by pairs of convey rollers 28, 58, 58*a*, 58*b*, 58*c*, 58*d*, 12 and 13, so that a new image is formed on a surface of the sheet opposite to the surface on which the image was previously formed.

Figure 6:
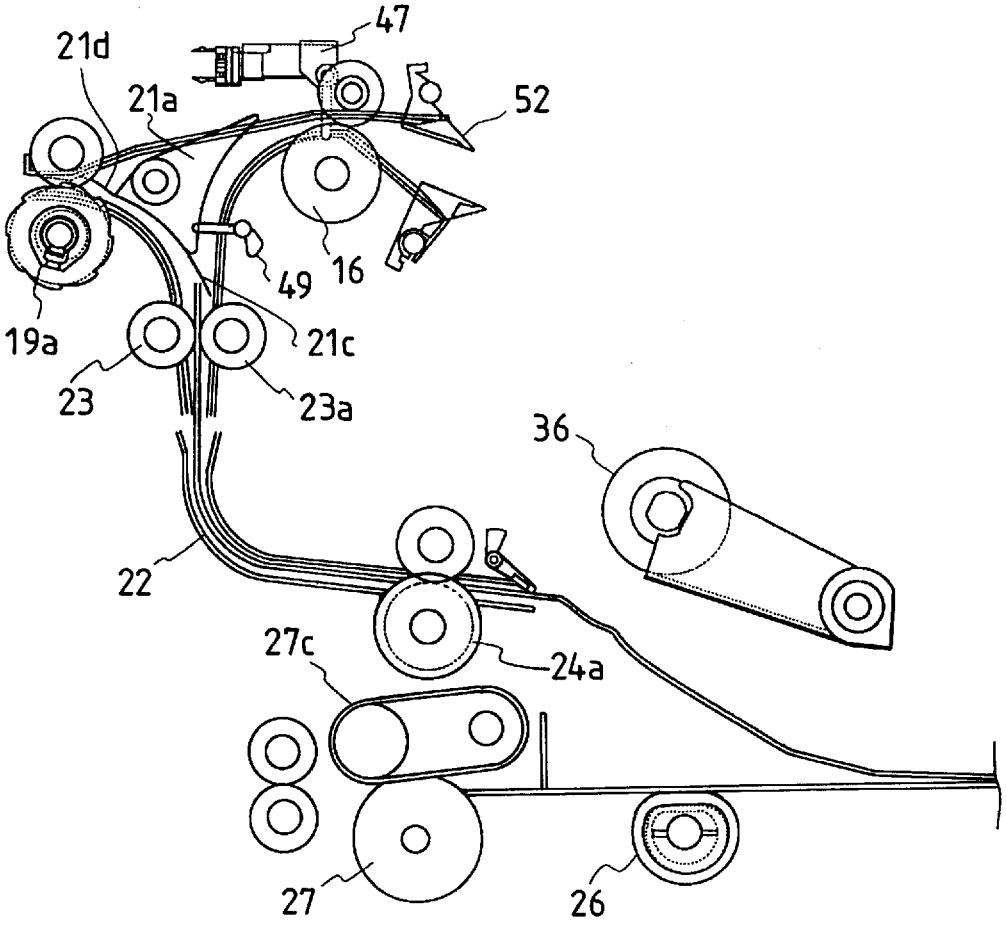
FIGS. 6 and 7 are explanatory views for explaining the operation of another embodiment of the first invention.
Figure 7:
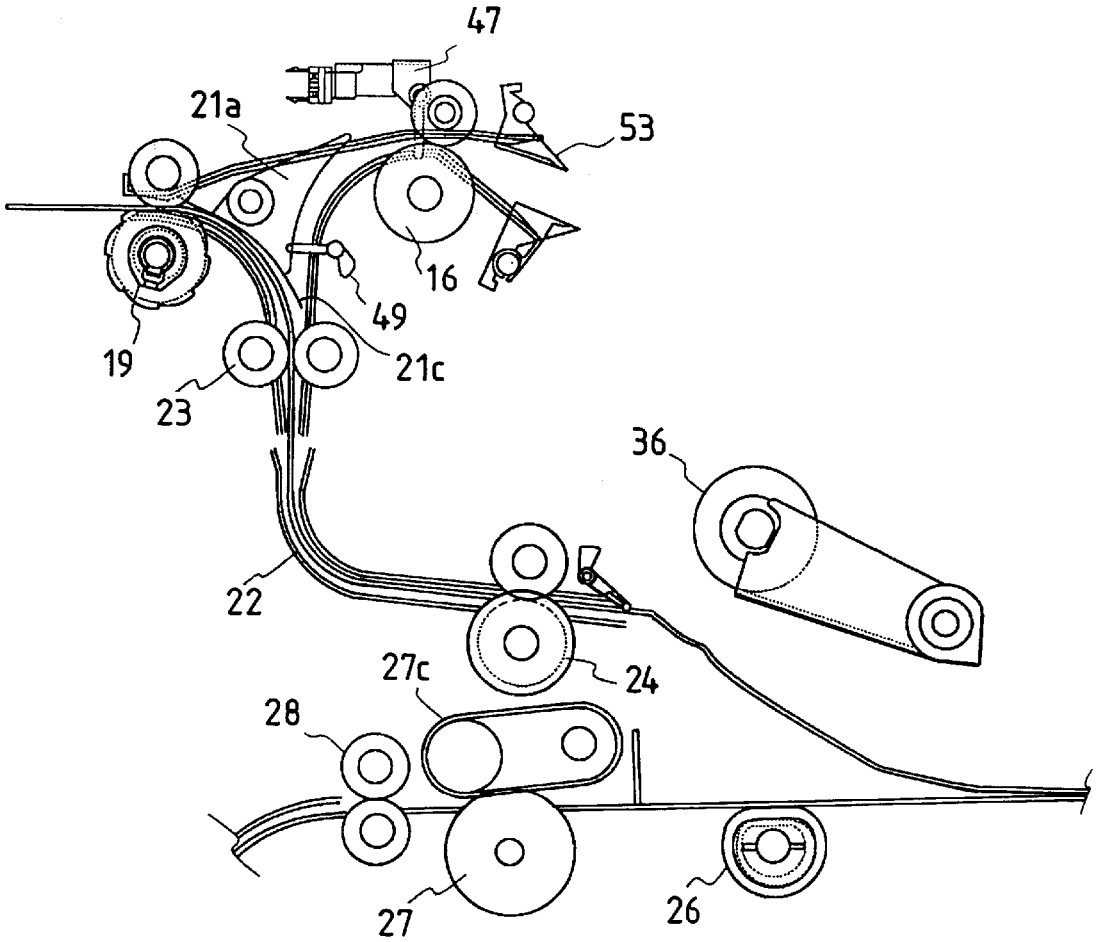

In the embodiment shown in FIGS. 6 and 7, in the multi copy mode, while the sheet on which the image was formed was rested on the both-face tray 25 after it was discharged out of the image forming apparatus by the pair of discharge rollers 19, in the apparatus shown in FIG. 1, by providing the multi flapper 30 for directing the sheet to the multi path 31 at a downstream side of the re-supply portion 27, 270, it is not required that the sheet is reversed out of the apparatus. In the multi mode, the sheet on one surface of which the image was copied is directed to a both-face convey path 240 by the both-face flapper 21 to be rested on the both-face tray 25. The sheet re-supplied by the feed-out roller 27 and a separation roller 270 is directed to the multi path 31 and the paired discharge rollers 24 by the action of the multi flapper 30. When a multi sensor arranged in the proximity of the multi flapper 30 detects the fact that the trailing end of the sheet passes through the multi flapper 30, the multi roller 32 and the discharge rollers 24 are rotated reversely, thereby sending the sheet to the both-face lower convey path 29 to effect the multi copying operation.

Figure 8:
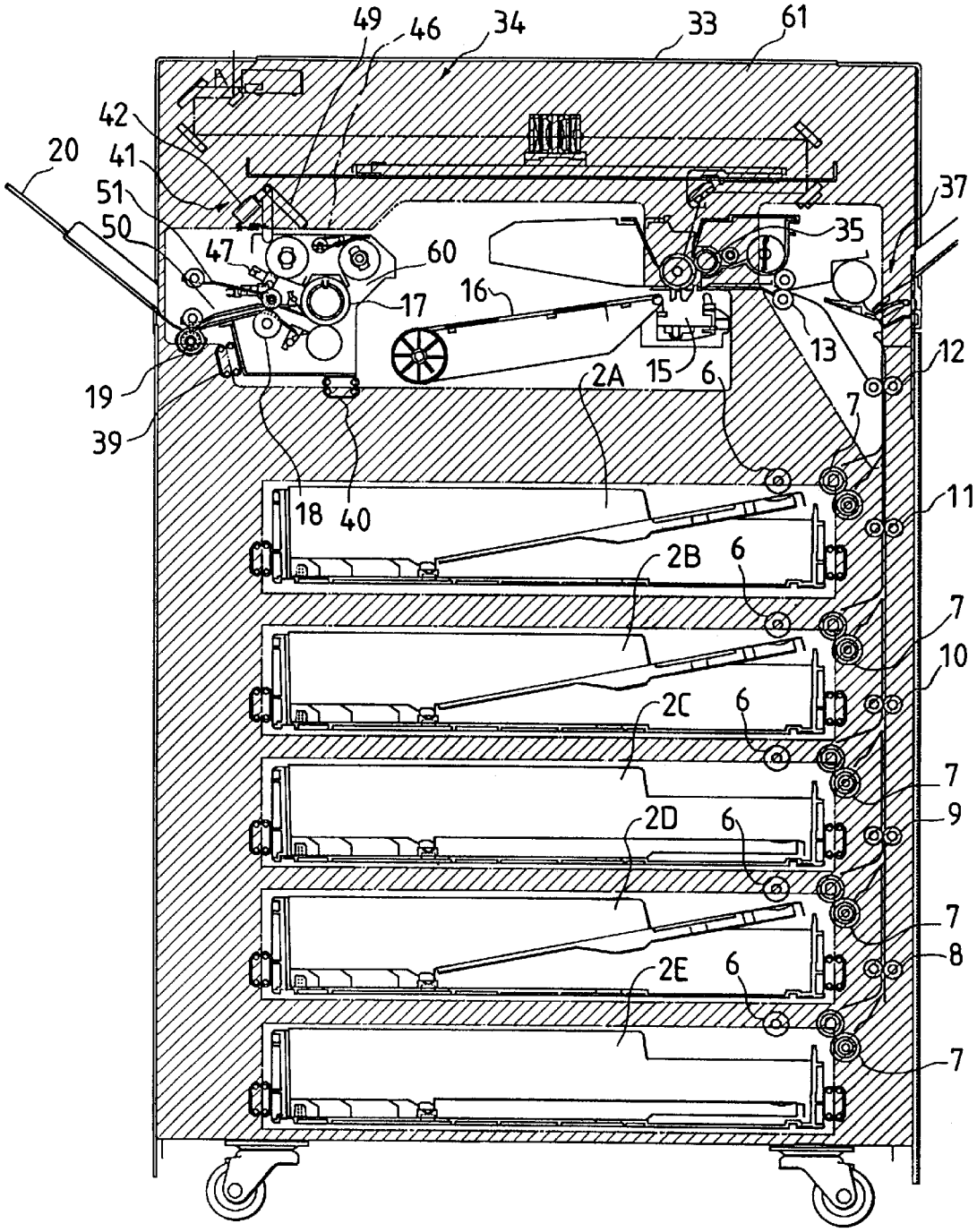
FIGS. 8 and 9 are sectional views showing a first embodiment (image forming apparatus) according to a second invention.

FIG. 8 shows the whole construction according to a first embodiment of a second invention.

Incidentally, in this embodiment, the same constructural and functional elements as those of the above-mentioned embodiment (FIG. 1) of the first invention are designated by the same reference numerals and the explanation thereof will be omitted.

An image forming apparatus according to the first embodiment of the second invention is a single-face copying machine wherein, after an image is fixed to the sheet by the fixing device 17, the sheet is discharged onto the discharge tray 20 disposed outside the machine by the pair of inner discharge rollers 18 and the pair of outer discharge rollers 19. A part unit 60 is constituted by the fixing device (pair of fixing rollers) 17, the pair of inner discharge rollers 18 and the pair of outer discharge rollers 19, which part unit can be retracted out of the image forming machine at its front side.

In case of this image forming apparatus, in the jam treatment, when the jammed sheet straddling between the part unit 60 and the convey belt 16 or between the part unit 60 and the discharge tray 20 is detected by the sheet detection sensor 47, the solenoid 42 of the lock mechanism 41 is maintained to the ON condition so that the part unit 60 cannot be retracted from the image forming apparatus.

In this condition, the fixing device 17, the pair of inner discharge rollers 18 and the pair of outer discharge rollers 19 are driven to positively discharge the jammed sheet onto the discharge tray 20. Thereafter, the solenoid 42 of the lock mechanism 41 is turned OFF, thereby releasing the locking condition of the part unit 60.

However, when the jam of the sheet straddling between the part unit 60 and the convey belt 16 is caused by the separating claw 53 of the fixing device 17, it is difficult to positively discharge the jammed sheet onto the discharge tray 20. In many cases, the trailing end of the jammed sheet straddling between the part unit 60 and the convey belt 16 does not reach the fixing device 17.

Figure 9:
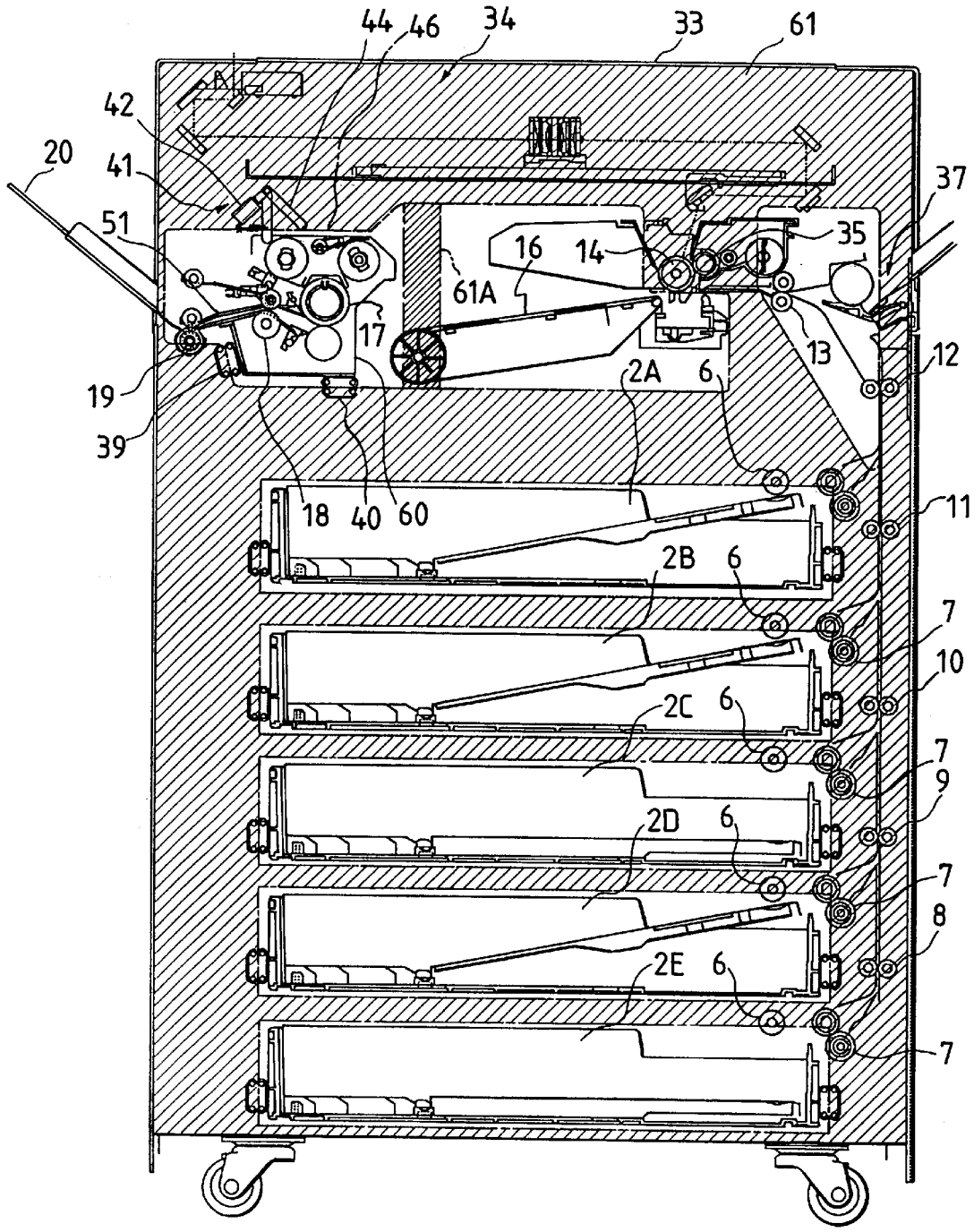

In this way, when the part unit 60 is retracted out of the image forming apparatus 1 in the condition that the trailing end of the sheet is positioned at an upstream side of the fixing device 17, as shown in FIG. 9, if a portion 61A of a front side plate (hatched portion) 61 of the image forming apparatus 1 is positioned at the upstream area of the fixing device 17, the jammed sheet will be torn by the front side plate 61, thereby making the jam treatment troublesome. Thus, the front side plate 61 is not made to be positioned at the upstream area of the fixing device 17, thereby preventing the damage of the sheet.

Incidentally, in order to perform the jam treatment regarding the part unit 60 retracted out of the image forming apparatus 1, the sheet discharge path 50 is opened by rotating the upper guide 51 upwardly.

Figure 10:
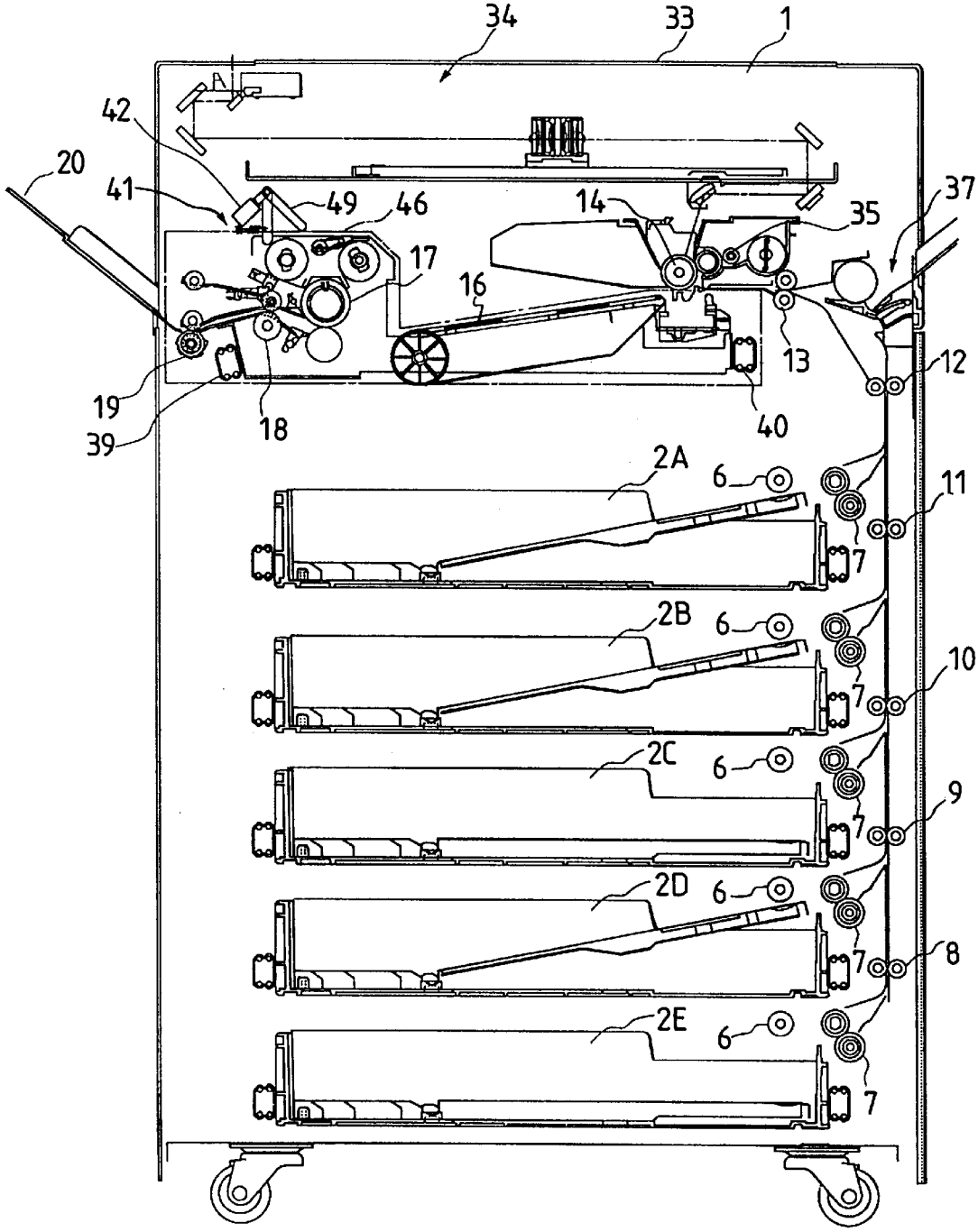
FIG. 10 is a sectional view showing a second embodiment according to the second invention.

FIG. 10 shows the whole construction according to a second embodiment of the second invention.

In the image forming apparatus (FIG. 8) according to the first embodiment of the second invention, while the part unit 60 was constituted by the fixing device 17, the pair of inner discharge rollers 18 and the pair of outer discharge rollers 19, in an image forming apparatus according to the second embodiment, a part unit 62 is constituted by the fixing device 17, the pair of inner discharge rollers 18, the pair of outer discharge rollers 19, the transfer device 15 and the convey belt 16, which part unit can be retracted out of the image forming apparatus 1 at its front side. With this arrangement, the sheet of large size jammed in the proximity of the fixing device 17 can effectively be treated. That is to say, if the sheet of large size is jammed in the proximity of the fixing device 17, since the trailing end of the sheet is positioned on the convey belt 16, when the convey belt 16 can be retracted out of the image forming apparatus 1 together with the fixing device 17, the jam treatment can easily be effected.

Figure 11:
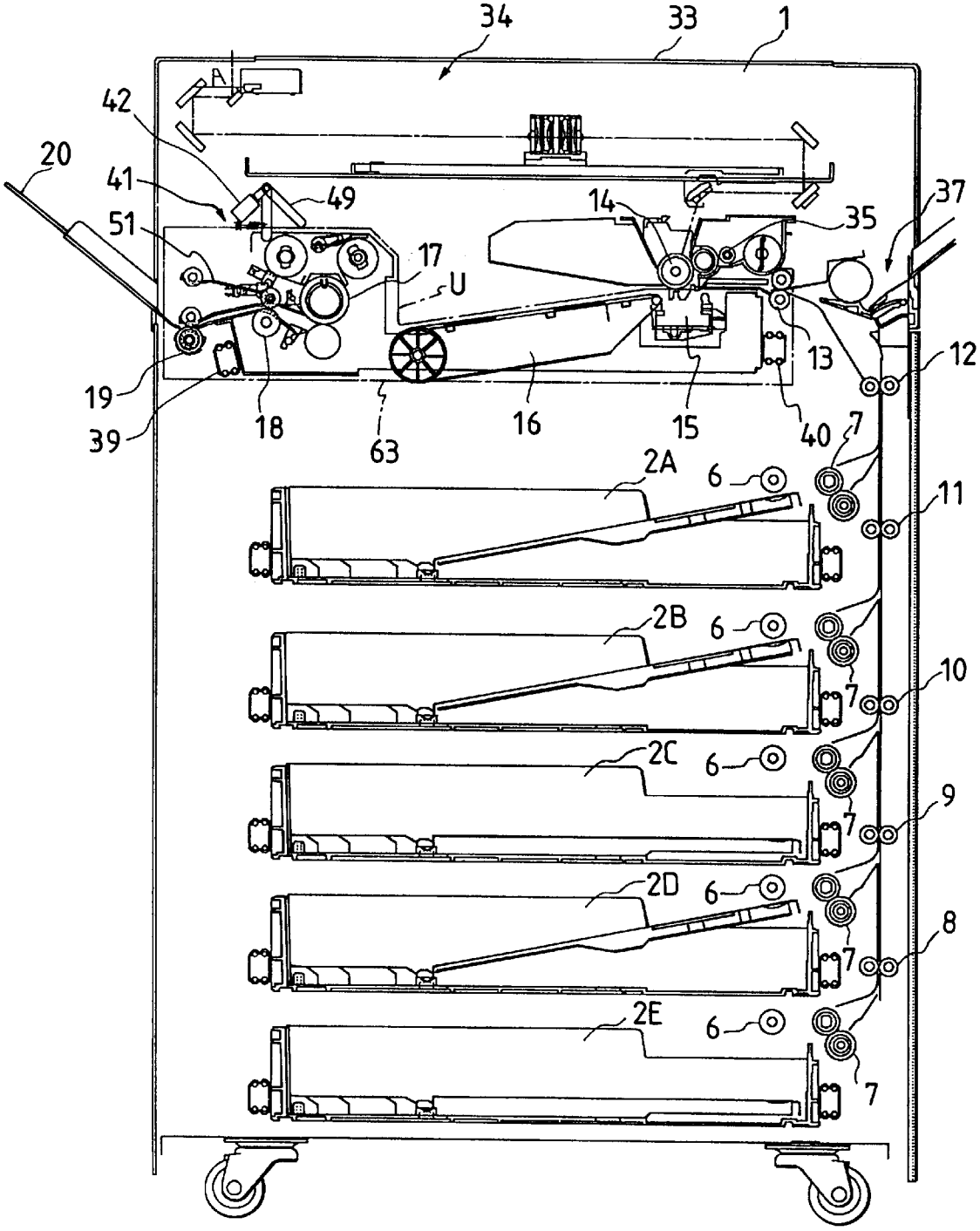
FIG. 11 is a sectional view showing a third embodiment according to the second invention.

FIG. 11 shows the whole construction according to a third embodiment of the second invention.

In the image forming apparatus (FIG. 10) according to the second embodiment of the second invention, while the sheet of large size jammed in the proximity of the fixing device 17 could easily be treated, in this third embodiment, even when the image forming apparatus 1 is made small-sized, the sheet of large size jammed in the proximity of the fixing device 17 can easily be treated. To this end, a part unit 63 is constituted by the fixing device 17, the pair of inner discharge rollers 18, the pair of outer discharge rollers 19, the pair of regist rollers 13, the transfer device 15 and the convey belt 16, which part unit can be retracted out of the image forming apparatus 1 at its front side.

When the image forming apparatus 1 is made small-sized, the trailing end of the sheet of large size jammed in the proximity of the fixing device 17 is sometimes pinched in a nip between the pair of regist rollers 13. In such a case, when the pair of regist rollers 13 can be retracted out of the image forming apparatus 1 together with the fixing device 17, the jam treatment can easily be effected.

Figure 12:
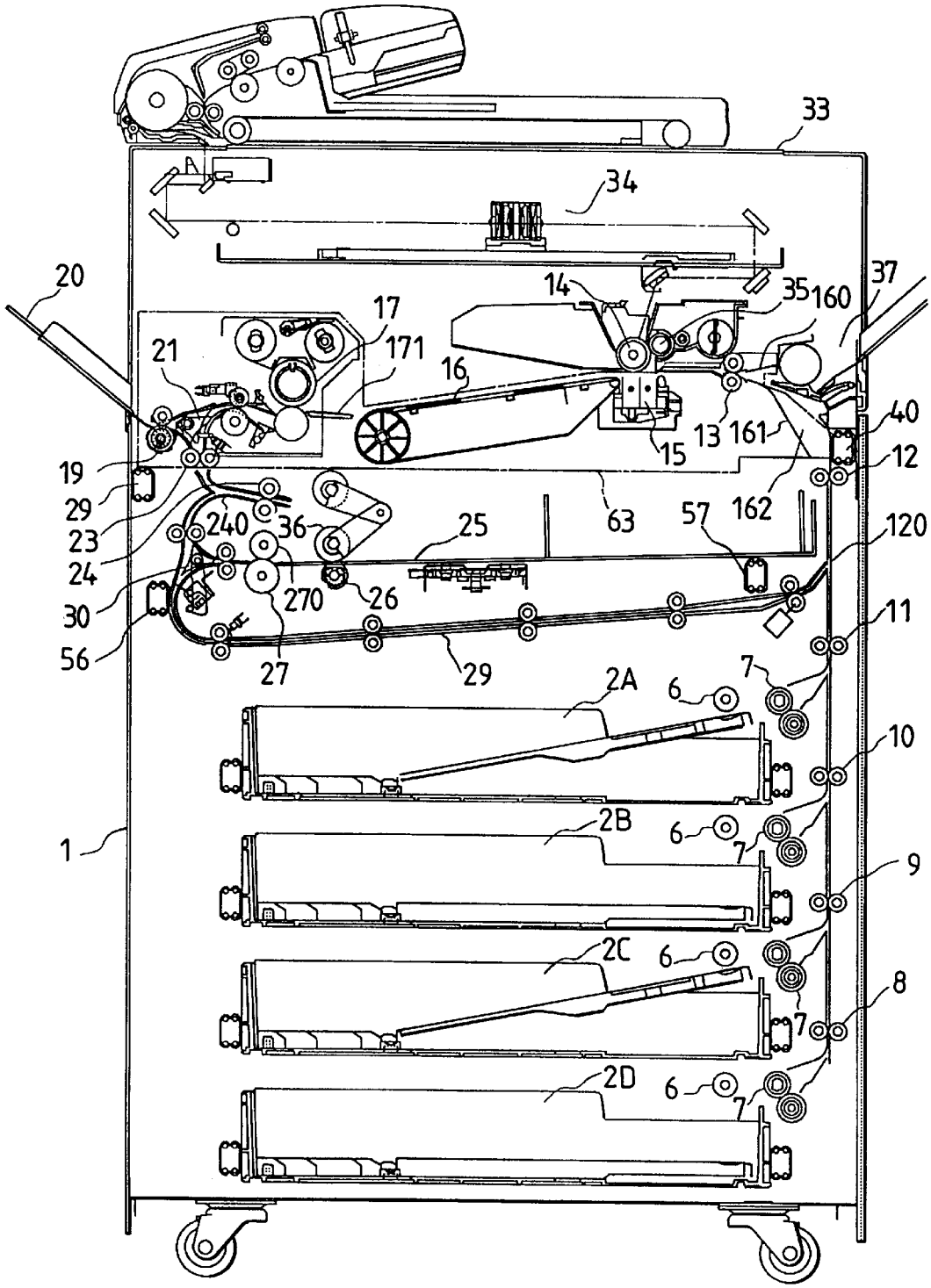
FIGS. 12 and 13 are sectional views showing a still further embodiment according to the first embodiment.

Incidentally, as shown in FIG. 12, a pre-regist upper guide 160 and a pre-regist lower guide 161 may also be included in the part unit 63 which can be retracted out of the image forming apparatus 1 at its front side.

Now, when the both-face copying operation is effected regarding a single-face imaged original, if the sheet is jammed at the discharge rollers 19, the discharge rollers 19 which cause the sheet jam are immediately stopped. The sheet between the paired regist rollers 13 and the paired pre-regist convey rollers 12 is sent into a space 162 by stopping the paired regist rollers 13 and by rotating the paired pre-regist convey rollers 12 until the trailing end of the sheet passes through the paired convey rollers 12. As a result, when the part unit 63 is retracted from the image forming apparatus, the sheet is not torn. Further, when the fixing device 17 is immediately stopped, the sheet below the photosensitive drum is conveyed in front of the fixing device, so that the sheet is remained on a fixing inlet guide 171. Further, if the sheet is straddling across a joint portion 120 between the part unit 63 and the longitudinal path guide, such sheet is shifted until the trailing end of the sheet passes through the joint portion 120 and a leading end of the sheet does not overlap with the part unit 63.

Figure 13:
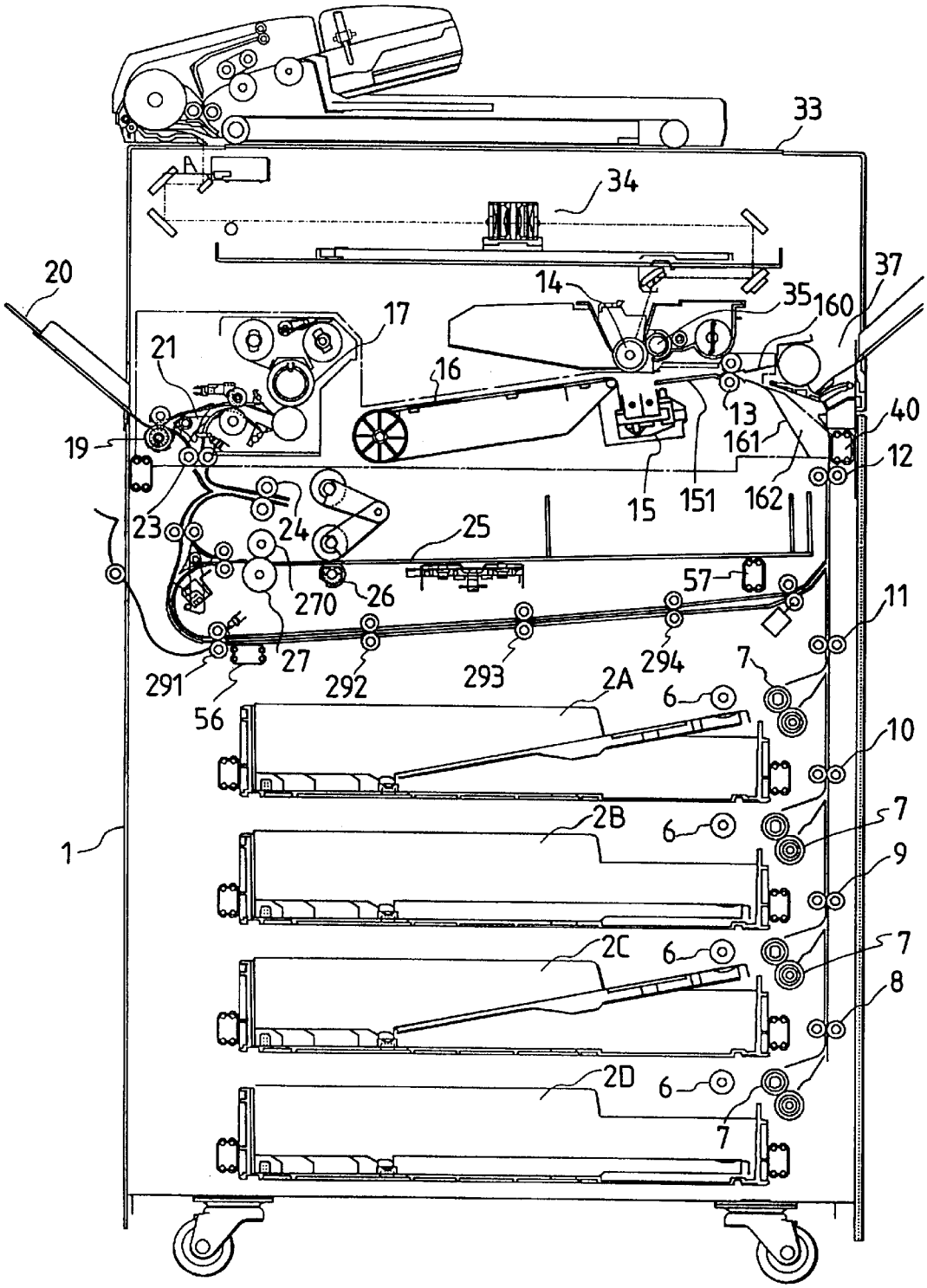

At this point, the jam condition is displayed on an operation portion (not shown), thereby informing an operator of the fact that the part unit 63 should be retracted to the front side. In this case, as shown in FIG. 13, the transfer device 15 and a pre-transfer lower guide 151 are rotated around the regist rollers 13 to retard from the photosensitive drum 14. Since the sheet is remained on the fixing inlet guide 171, the operator does not need to effect the jam treatment by inserting his hand below the photosensitive drum, thereby preventing the contamination and/or damage of the photosensitive drum.

Figure 14:
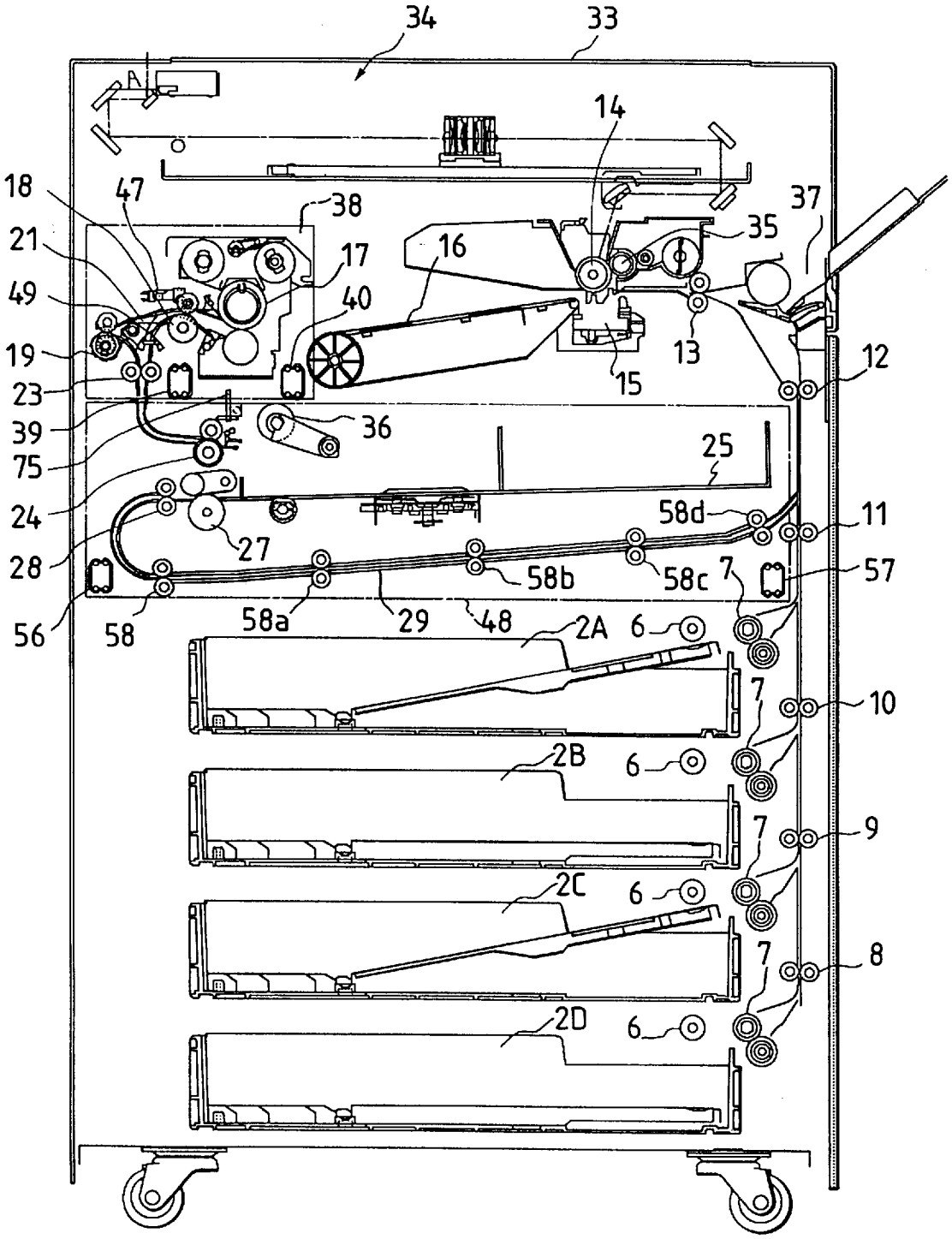
FIG. 14 is a sectional view showing a first embodiment (image forming apparatus) according to a third invention.

FIG. 14 shows the whole construction of an embodiment (image forming apparatus) according to a third invention.

Incidentally, in an image forming apparatus according to this embodiment, the same constructural and functional elements as those of the first embodiment (FIG. 1) of the first invention are designated by the same reference numerals and the explanation thereof will be omitted.

In the image forming apparatus according to this embodiment, when a fixing unit (part unit) 38 and a both-face unit (part unit) 48 which can be retracted out of the image forming apparatus 1 at its front side are retracted out of the image forming apparatus 1, these units are interlocked to each other by a unit lock mechanism (unit lock means) 66 which will be described later. And, when the fixing unit 38 and the both-face unit 48 are accommodated in the image forming apparatus 1, a locking condition of the unit lock mechanism 66 is released and these units are locked to the image forming apparatus 1 by a body lock mechanism (body lock means) 65 which will be described later.

Figure 15:
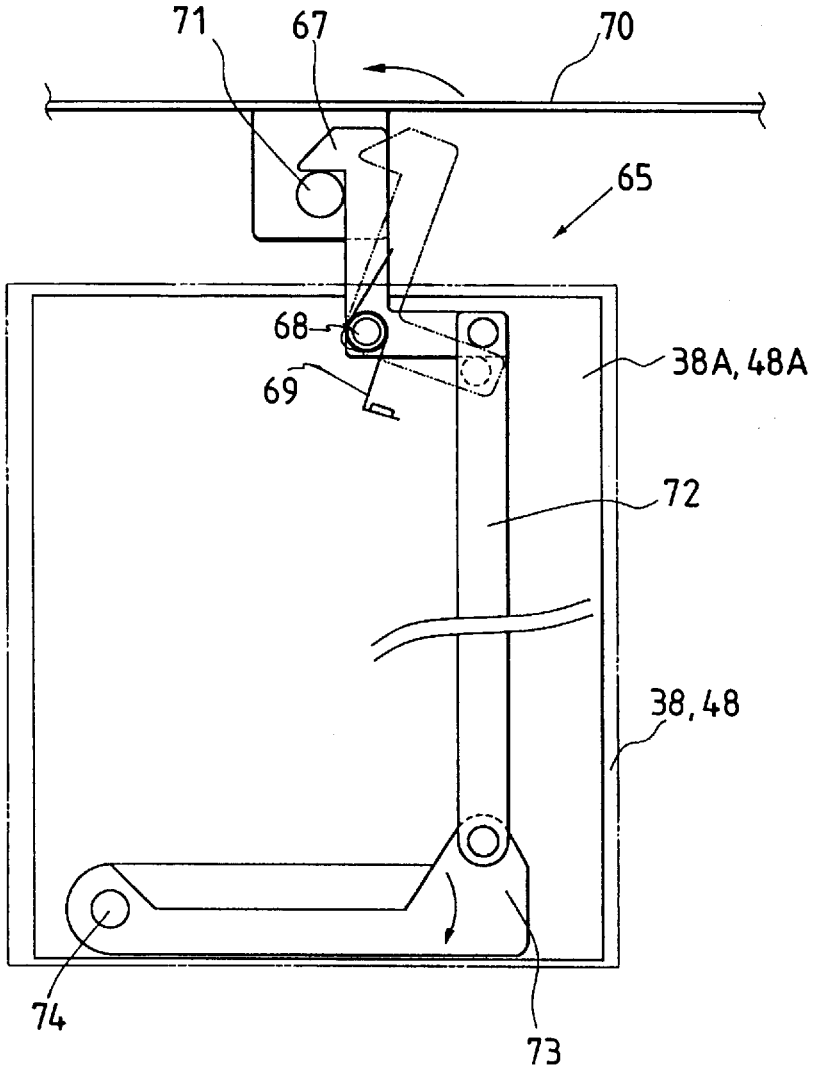
FIG. 15 is an explanatory view showing a body lock mechanism of FIG. 14.

FIG. 15 shows a construction of the body lock mechanism 65 for locking the fixing unit 38 and the both-face unit 48 to the image forming apparatus 1.

A lock arm 67 is rotatably mounted on fixed plates 38A, 48A of the fixing unit 38 and the both-face unit 48 via a support pin 68. The lock arm 67 is always biased toward a direction shown by the arrow by a lock spring 69 and is attached to a rear side plate 70 of the image forming apparatus 1, so that the lock arm can be engaged by a ratch shaft 71 mounted on the rear side plate 70 of the image forming apparatus 1.

Further, the lock arm 67 is rotatably connected to a release ring 72 the other end of which is rotatably connected to a gripper 73. The gripper 73 is journalled to a gripper shaft 74. When the fixing unit 38 and the both-face unit 48 are retracted this side, by shifting the gripper 73 in a direction shown by the arrow, the lock arm 67 is rotated in a clockwise direction (to a position shown by the phantom line) via the release ring 72, thereby releasing a locking condition of the fixing unit 38 and the both-face unit 48 with respect to the image forming apparatus 1.

When the fixing unit 38 and the both-face unit 48 are inserted into the image forming apparatus, an inclined head of the lock arm 67 is contacted with the ratch shaft 71 to shift the lock arm once to a position shown by the phantom line.

Then, since the lock arm is returned to a position shown by the solid line by the action of the lock spring 69, the fixing unit 38 and the both-face unit 48 are automatically locked.

FIG. 16 shows the unit lock mechanism 66 for locking the fixing unit 38 and the both-face unit 48 retracted out of the image forming apparatus 1 (in a condition that the fixing unit 38 and the both-face unit 48 have been retracted out of the image forming apparatus 1).

In the both-face unit 48, a vertically extending unit lock pin 75 is supported by pin support plates 76, 77 for sliding movement in an up-and-down direction. The unit lock pin 75 is biased upwardly by a pin spring 78 to protrude upwardly from the both-face unit 48. A hole 79 formed in a bottom plate 38A of the fixing unit 38 can receive the unit lock pin 75.

Further, the both-face unit 48 is provided with a horizontal release shaft 80 for shifting the unit lock pin 75 in the up-and-down direction. The release shaft 80 is supported by shaft support plates 81, 82 for sliding movement in directions shown by the double headed arrow. The release shaft 80 is always biased toward the rear side plate 70 by a shaft spring 83. Further, a cam surface 81A formed on a free end of the release shaft 80 is contacted with a pin roller 84 of the unit lock pin 75.

In FIG. 16, since the release shaft 80 is biased toward the rear side plate 70 by the shaft spring 83 so that the release shaft cannot lower the unit lock pin 75, the unit lock pin 75 is engaged by the hole 79 of the part unit 63, thereby interlocking the both-face unit 48 and the part unit 63.

Figure 17:
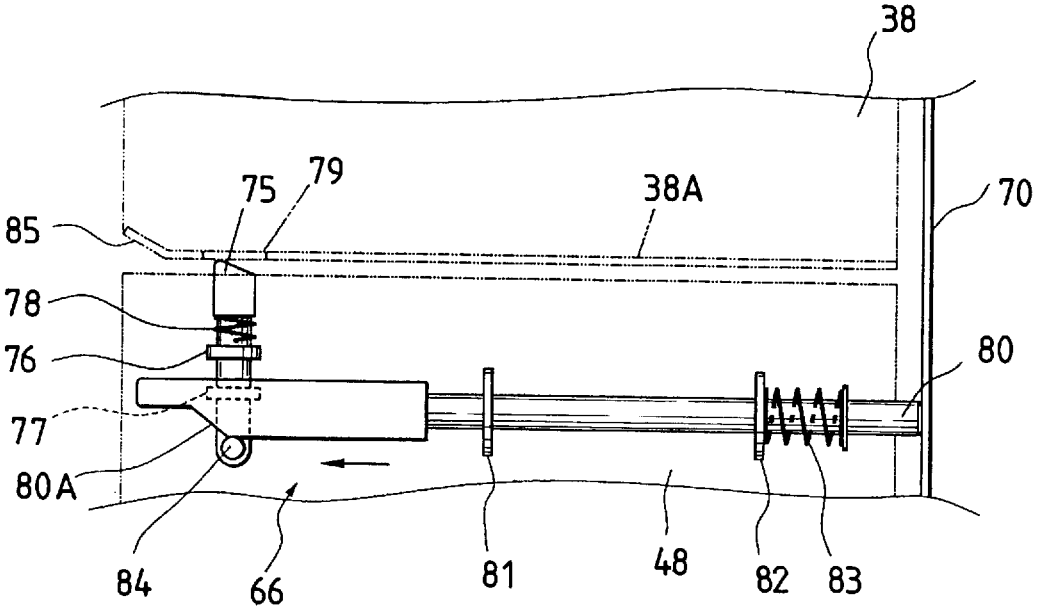

FIG. 17 shows a condition that the fixing unit 38 and the both-face unit 48 which were retracted as shown in FIG. 16 are accommodated in the image forming apparatus 1. Although the fixing unit 38 and the both-face unit 48 are inserted into the image forming apparatus while being interlocked by the unit lock pin 75, when the rear end of the release shaft 80 is abutted against the rear side plate 70, since the release shaft 80 is shifted to the direction shown by the arrow (to the left) by the rear side plate 70, the unit lock pin 75 is pushed down by the cam surface 80A to lower. As a result, the unit lock pin 75 is disengaged from the hole 79, thereby releasing the locking condition between the fixing unit 38 and the both-face unit 48.

Figure 18:
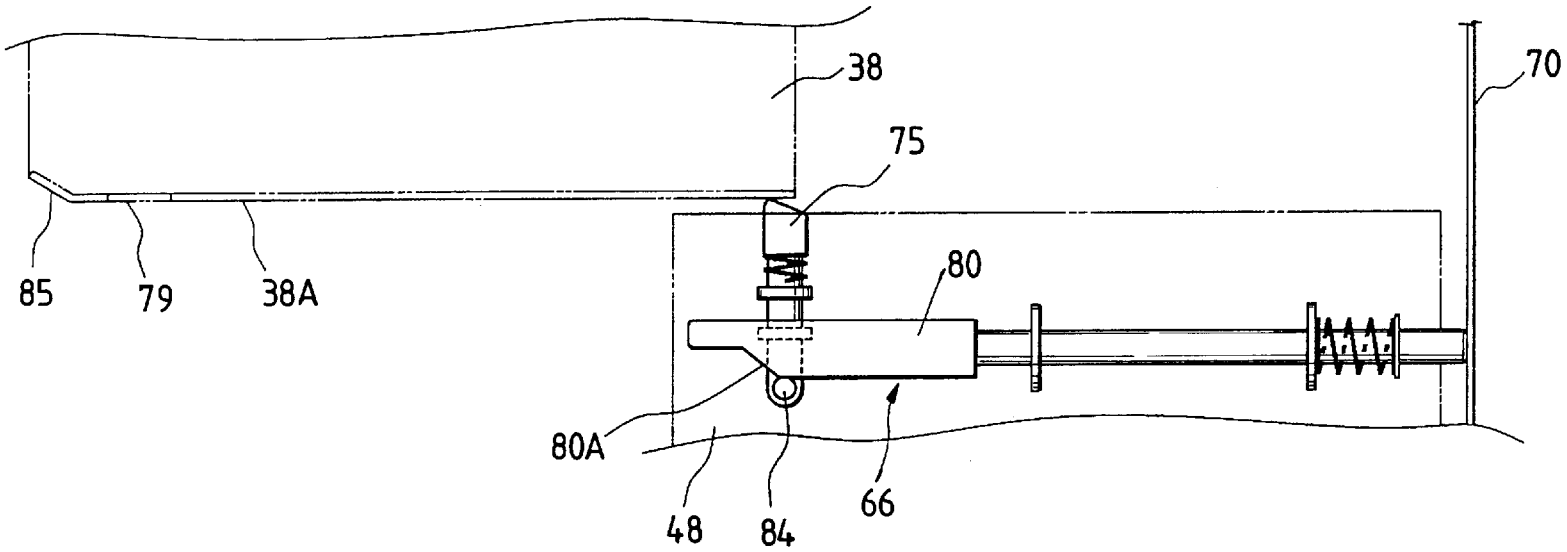

FIG. 18 shows a condition that only the fixing unit 38 has been retracted out of the image forming apparatus 1. In this condition, when the operator tries to retract the both-face unit 48, since the retarded unit lock pin 75 can slide on the back surface of the bottom plate 38A of the fixing unit 38, the both-face unit 48 can surely be retracted. When the unit lock pin 75 reaches the hole 79, the pin 75 is engaged with the hole 79, thereby restoring the locking condition between the fixing unit 38 and the both-face unit. Accordingly, the fixing unit 38 and the both-face unit 48 can be inserted into the image forming apparatus in a body.

Figure 19:
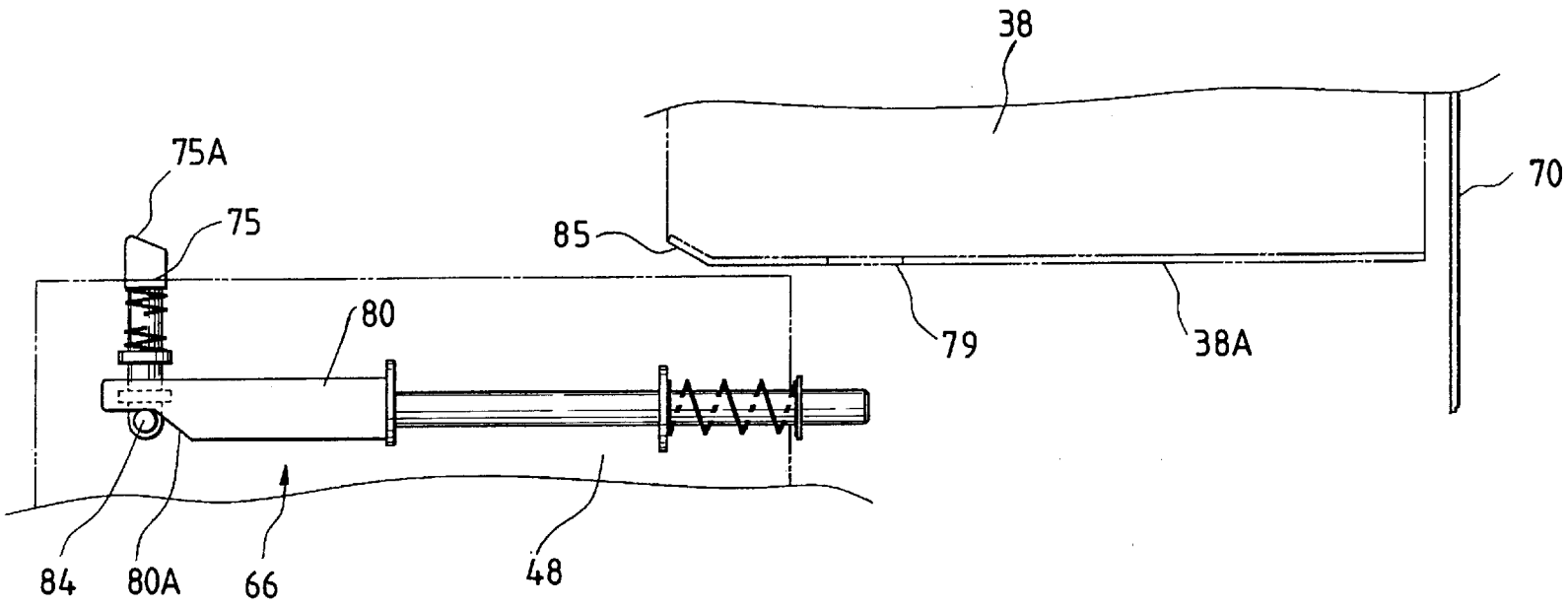

FIG. 19 shows a condition that only the both-face unit 48 has been retracted out of the image forming apparatus 1. In this condition, when the operator tries to retract the fixing unit 38, since an inclined surface 85 at a front end portion of the fixing unit 38 is engaged by an inclined top surface 75A of the unit lock pin 75 to lower or retard the unit lock pin 75, the fixing unit 38 can surely be retracted. Also, in this case, in the retracted condition, since the fixing unit 38 and the both-face unit 48 are interlocked to each other, these units can be inserted into the image forming apparatus in a body.

Incidentally, in the above-mentioned embodiment, while an example that the fixing unit 38 and the both-face unit 48 are interlocked to each other by the unit lock mechanism 66 when these units are retracted out of the image forming apparatus 1 was explained, the fixing unit 38 and the both-face unit 48 may be interlocked to each other by using a unit lock means which can releasably interlock these units when these unit are accommodated in the image forming apparatus 1. In this arrangement, there are provided a lock release means for releasing the unit lock means, and a sheet detection means for detecting the sheet jammed in the unit 38 or 48. And, when the sheet detection means detects the fact that the sheet is not jammed in either of the units 38, 48, the locking condition of the unit lock means is released by the lock release means.

Figure 20:
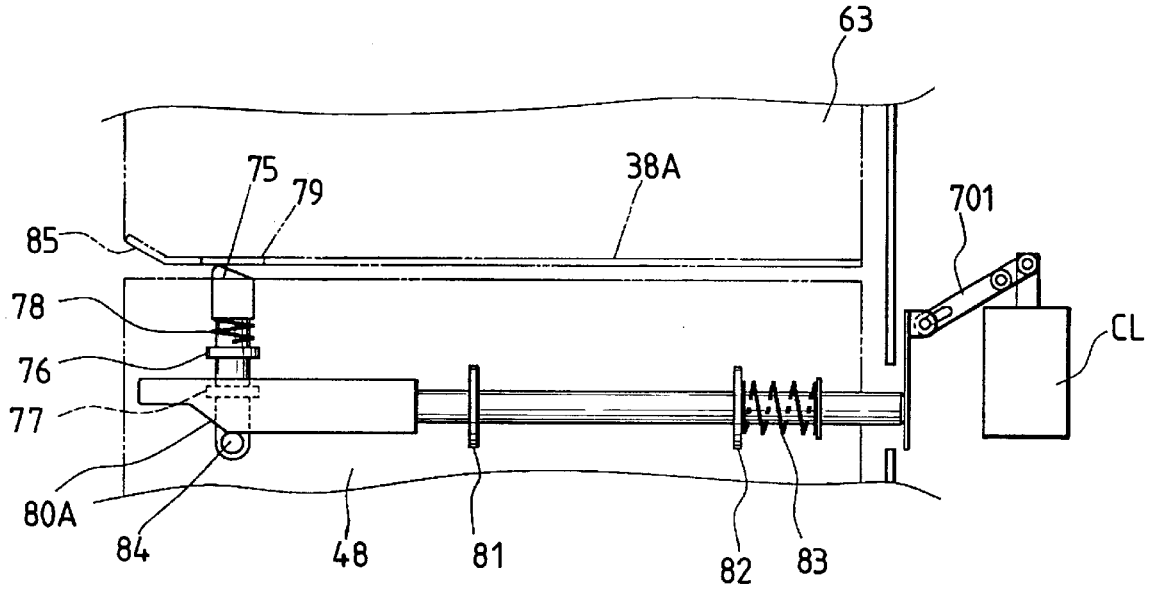

For example, in FIG. 12, if the sheet is jammed while straddling between the part unit 63 and the both-face unit 48, a condition as shown in FIG. 20 will be attained. In this condition, since the release shaft 80 is biased against an actuator plate 700 by the shaft spring 83 so that the unit lock pin 75 is maintained in the lowered position, the both-face unit 48 and the part unit 63 are kept in the interlocked condition.

Figure 21:
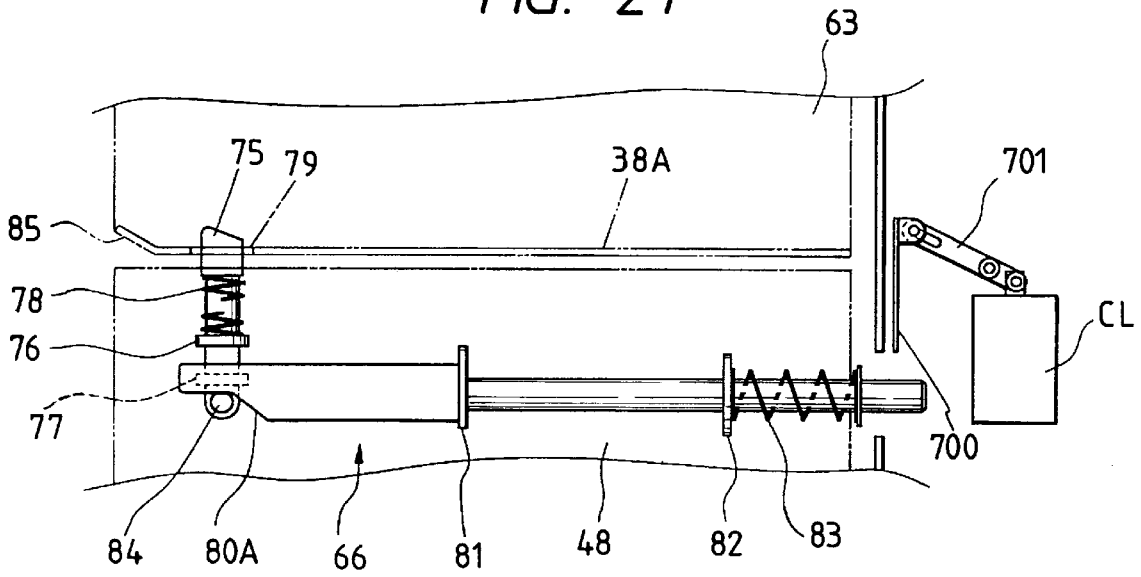

On the other hand, if the sheet jam is caused in any paths other than the path between the part unit 63 and the both-face unit 48, as shown in FIG. 21, the actuator plate 700 is retarded from the release shaft 80 by a link 701 connected to a solenoid CL. As a result, since the release shaft 80 is shifted to the right, the both-face unit 48 and the part unit 63 are interlocked to each other. Therefore, since only the unit in which the sheet is jammed can be retracted and since the units 38, 48 can be retracted in a body if the sheet is jammed while straddling between these units 38, 48, the jammed sheet is not torn.

Of course, in order to achieve the above advantage, the discharge means, intermediate tray, convey path and mode change means may be incorporated as a unit which is supported by a support means for supporting the unit so that the unit can be retracted in a substantially horizontal direction transverse to the sheet discharge direction.

As shown in FIG. 13, the discharge side sheet path guides of the sheet discharge portion and switch-back portion 30 are rotatably supported on a roller shaft of the convey roller 291 so that the guides can be rocked outwardly. Thus, the jam treatment regarding the both-face unit can be effected by retracting the both-face unit this side and by rotating the sheet path guides of the discharge portion and switch-back portion toward the discharge side.

Figure 22:
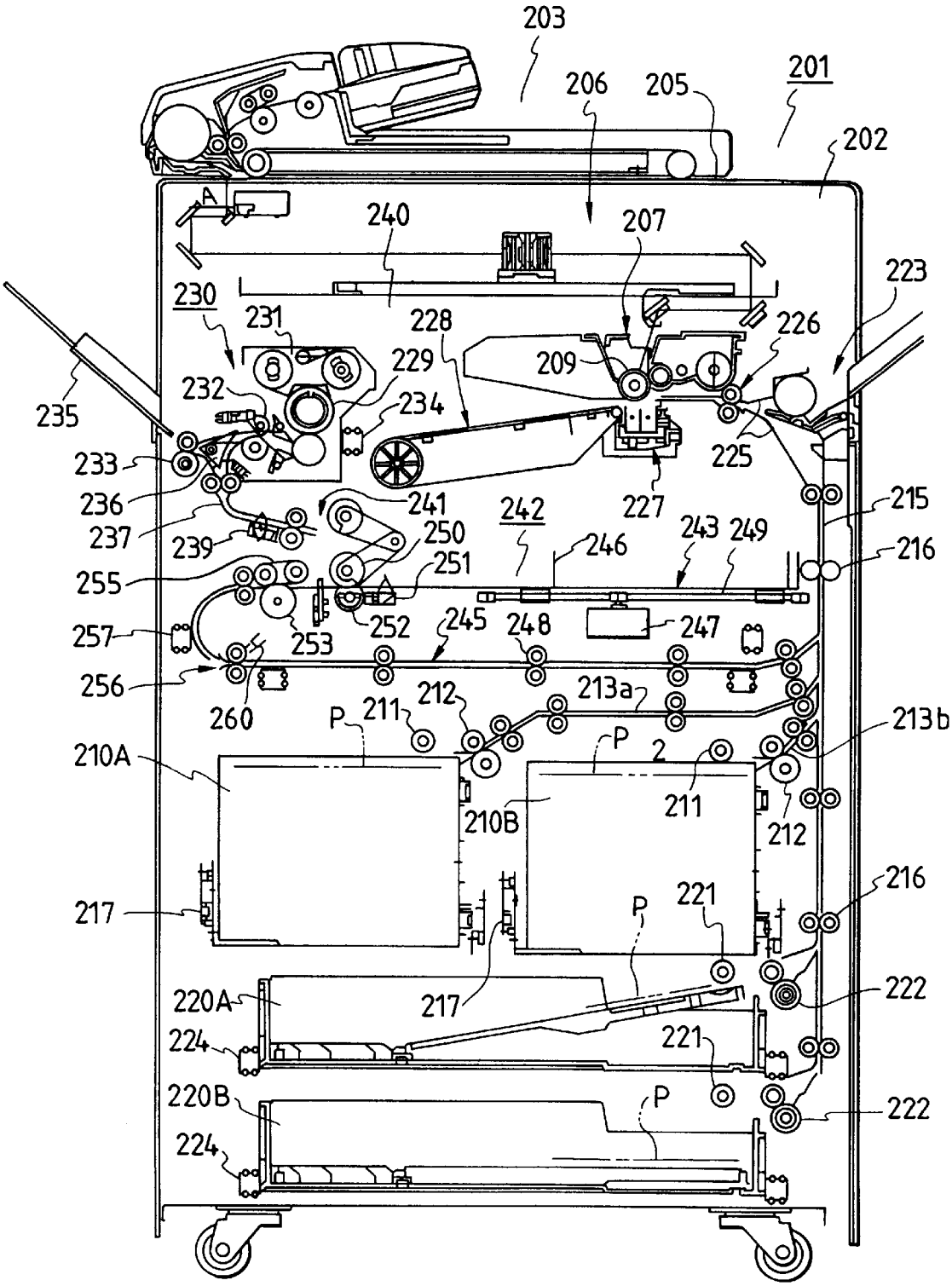
FIG. 22 is a longitudinal side sectional view showing the whole construction of an embodiment (image forming apparatus) according to a fourth invention.

FIG. 22 shows the whole construction of a first embodiment (image forming apparatus) according to a fourth invention.

First of all, the whole construction of the image forming apparatus will be briefly explained along a flow of a sheet.

In FIG. 22, an original (not shown) is automatically supplied onto a platen glass 205 disposed on a body 202 of a copying machine 201 as the image forming apparatus by an automatic original supply device 203. By scanning the original by an optical system 206, a latent image is formed on a photosensitive drum 209 in an image forming portion 207. The latent image is developed as a toner image on the photosensitive drum 209.

A plurality of sheet supply decks 210A, 210B each containing a number of sheets P are arranged within the body 202 of the machine. The sheets fed out from each sheet supply deck are separated one by one by a corresponding sheet supply roller 211 and a corresponding separation and convey roller 212. The sheets P supplied from the sheet supply decks 210A, 210B are sent to a regist introduction path 215 through deck paths 213*a*, 213*b*, respectively. The sheet supply decks 210A, 210B are guided by guide rails 217 so that the decks can be retracted at a front side of the machine body 202 (front loading decks). A plurality of sheet supply cassettes 220A, 220B each containing a number of sheets P are arranged below the sheet supply decks 210A, 210B. The sheets from the sheet supply cassettes are separated one by one by a corresponding sheet supply roller 221 and a corresponding separation and convey roller 222, and the separated sheet P is sent to the regist introduction path 215. The sheet supply cassettes 220A, 220B are also guided by guide rails 224 so that the cassettes can be retracted at a front side of the machine body (front loading cassettes).

A pre-regist guide 225 for guiding the sheet P conveyed from the regist introduction path 215 and a sheet P supplied from a manual sheet insertion portion 223, and a pair of regist rollers 226 are arranged at a downstream side of the regist introduction path 215. The toner image is transferred onto the sheet P conveyed by the paired regist rollers 226, by a transfer separation charger portion 227. The sheet to which the toner image was transferred is sent, by a convey portion 228, to a fixing portion 231, where toner image is fixed to the sheet by a fixing roller 229. Thereafter, the sheet P is discharged onto a sheet discharge tray 235 through a pair of inner discharge rollers 232, a switching member (switching portion) 236 and a pair of outer discharge rollers 233.

A fixing discharge portion (fixing discharge unit) 230 is constituted by the fixing portion 231, the discharge rollers 232, 233 and a sheet path 237, which fixing discharge portion 230 is guided by a guide rail 234 so that it can be retracted from the machine at its front side (front loading type). A part unit 240 is constituted by the fixing discharge portion 230, or by at least one of the fixing discharge portion 230, pre-regist guide 225, regist rollers 226, transfer separation charger portion 227 and convey portion 228. The part unit 240 is of front loading type with respect to the machine body 202.

A both-face unit 242 including an intermediate tray 243 is arranged below the part unit 240. In the illustrated embodiment, the both-face unit 242 comprises the intermediate tray 243, and a both-face convey portion 245 integrally connected to the intermediate tray at a junction 256 adjacent to the intermediate tray.

In the multi copy mode, the sheet P which had been discharged on the discharge tray 235 is directed to the sheet path 237 by a switching member 236 and then is discharged onto the intermediate tray 243 through a joint portion 241. On the other hand, in the both-face copy mode, the sheet P is discharged from the first joint portion 241 onto the intermediate tray 243 through the pair of inner discharge rollers 232, switching member 236 and sheet path 237. The sheets P discharged on the intermediate tray 243 are aligned so that trailing ends of the sheets are registered by a regulating plate 246 movable in left and right in FIG. 22 and leading ends of the sheets are entered between a re-supply roller 252 and a hold-down roller 250. The regulating plate 246 is driven by a convey belt 249 which can be reversibly rotated by a motor 247. Incidentally, the reference numeral 251 denotes a detection sensor for detecting the presence/absence of the sheet P on the intermediate tray 243. The hold-down roller 250 is retarded upwardly when the sheet P is discharged onto the intermediate tray 243.

The sheet P supplied by the re-supply roller 252 is conveyed by a separation convey means comprising a convey roller 253 and a separation belt 255, and is introduced into the regist introduction path 215 via a both-face convey portion 245. The reference numeral 260 denotes a sheet detection sensor for detecting the sheet P passing through the junction 256.

Figure 23:
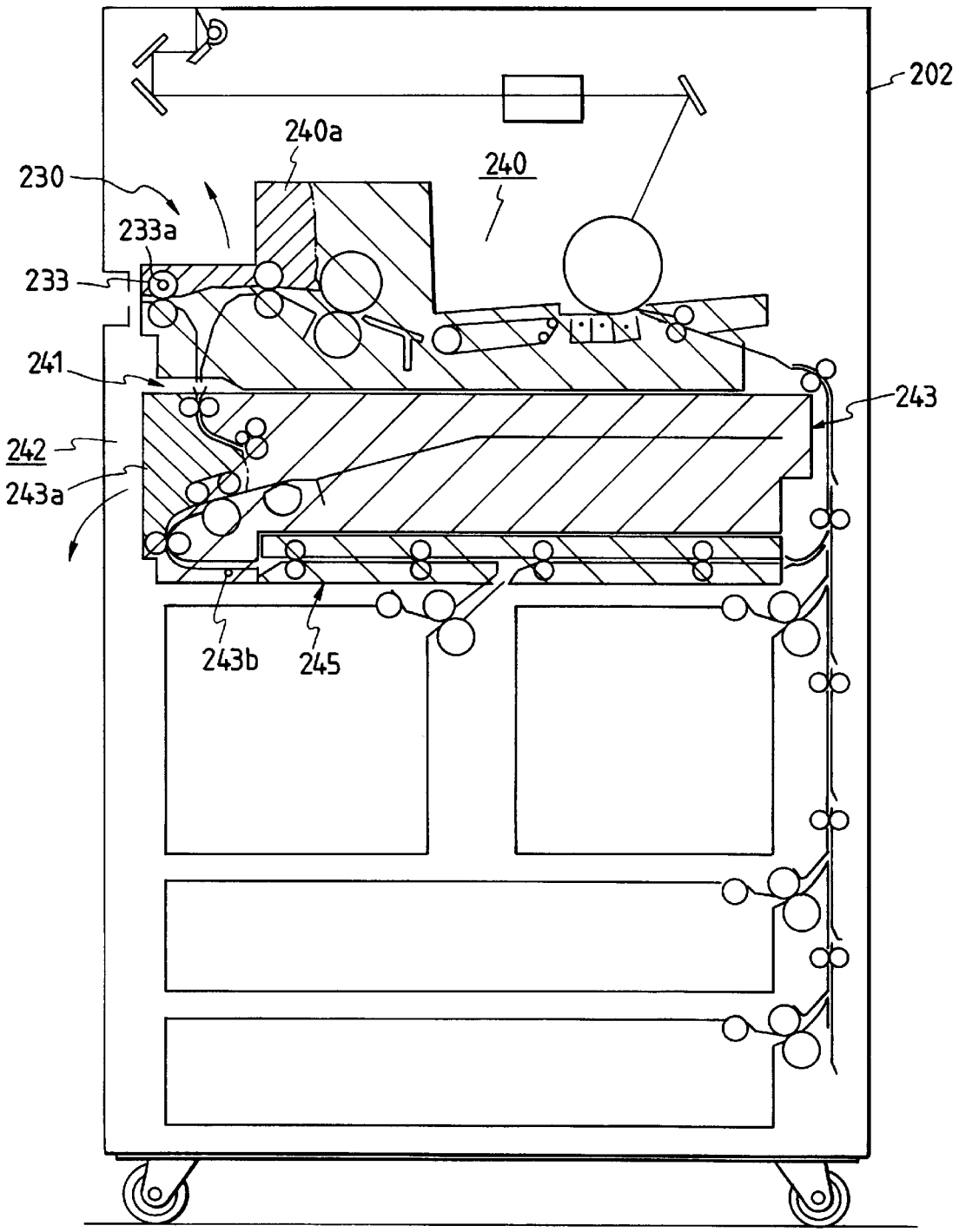
FIG. 23 is a longitudinal side sectional view of the image forming apparatus showing an example of part units.

FIG. 23 shows one kind of the part unit 240. In FIG. 23, as mentioned above, the part unit 240 is constituted by the fixing portion 231, discharge rollers 232, 233, and fixing discharge portion 230 comprising the switching member 236.

If the sheet is jammed in the first joint path portion 241 between the part unit 240 and the both-face unit 242, the part unit 240 and the both-face unit 242 are retracted from the machine body 202 in a body as described later. The jam treatment is performed by rotating a movable portion 240*a* of the part unit 240 in a direction shown by the arrow and by rotating a movable portion 243*a* of the intermediate tray 243 in a direction shown by the arrow.

Figure 24:
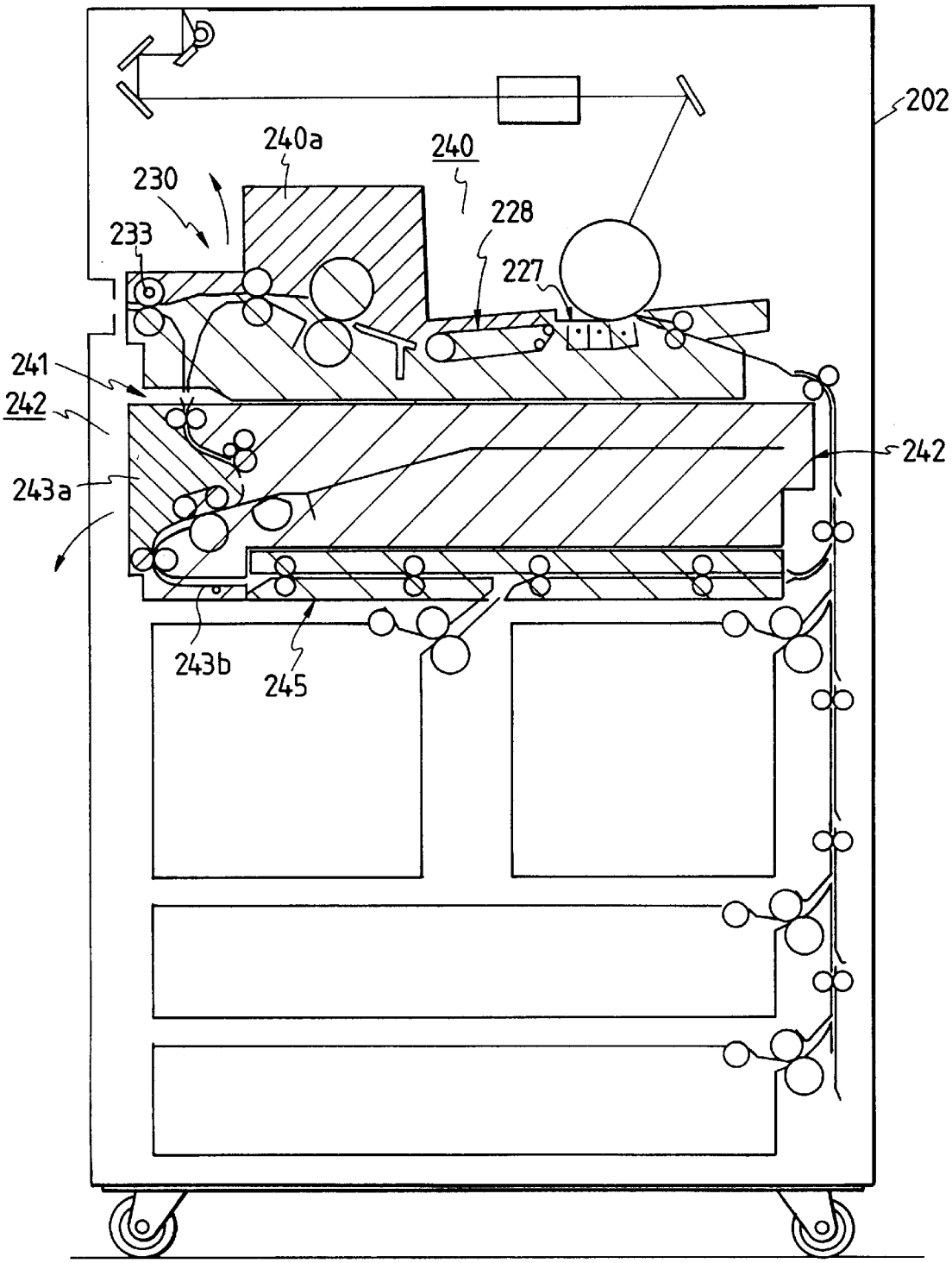
FIG. 24 is a longitudinal side sectional view of the image forming apparatus showing another example of part units.

In FIG. 24, the part unit 240 is constituted by the fixing discharge portion 230, convey portion 228 and transfer separation charger portion 227. In this part unit 240, after the part unit 240 is retracted, the jammed sheet is removed by rotating the movable portion 240*a* in a direction shown by the arrow.

Figure 25:
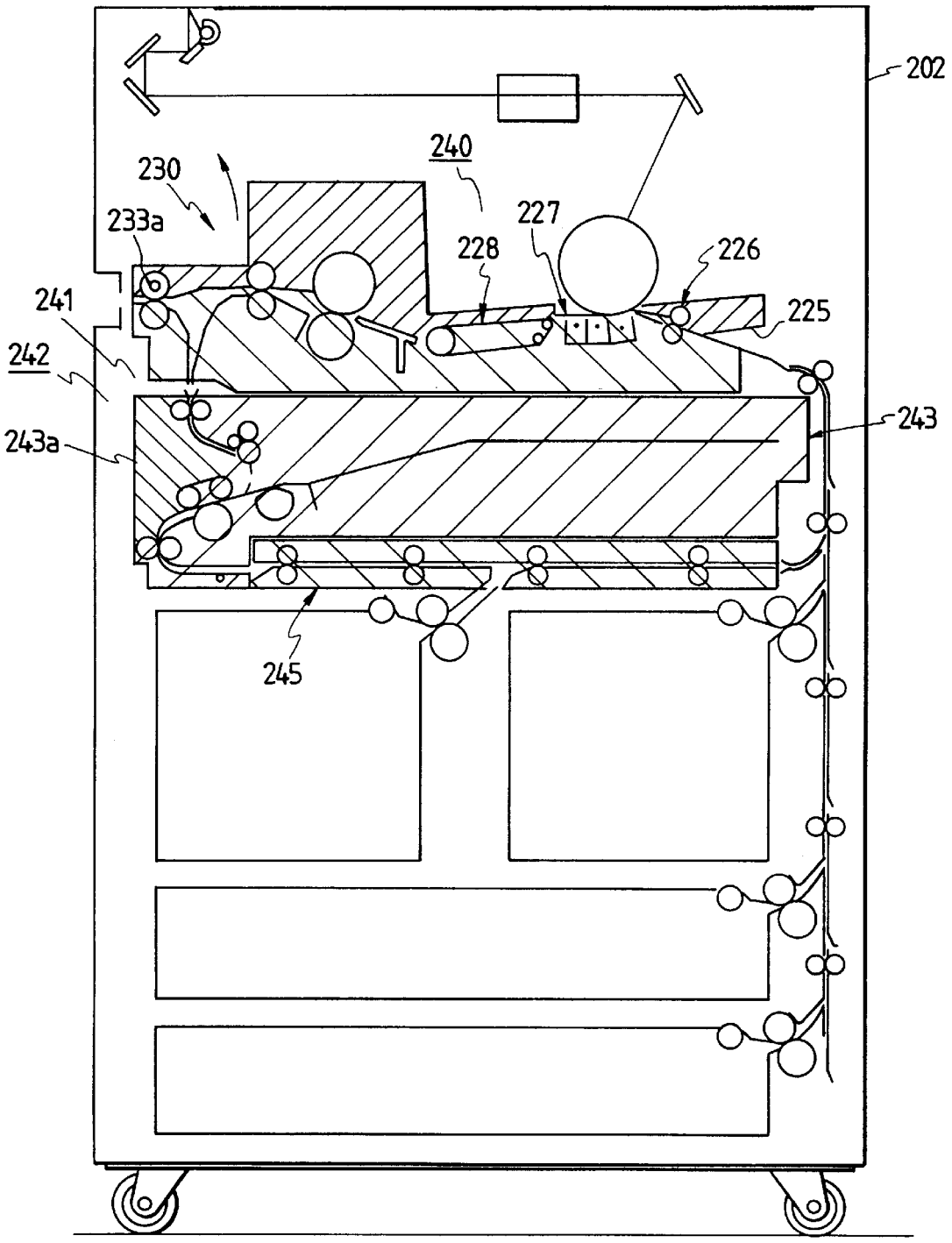
FIG. 25 is a longitudinal side sectional view of the image forming apparatus showing a further example of part units.

In FIG. 25, the part unit 240 is constituted by the fixing discharge portion 230, convey portion 228, transfer separation charger portion 227, regist rollers 226 and pre-regist guide 225. If the sheet is jammed in the first joint path portion 241, the jammed sheet is removed after the movable portion 240*a* is rotated in a direction shown by the arrow. A body lock mechanism for locking the part unit 240 and the both-face unit 242 to the image forming apparatus 201 has the same construction as that explained with reference to FIG. 15.

Figure 26A:
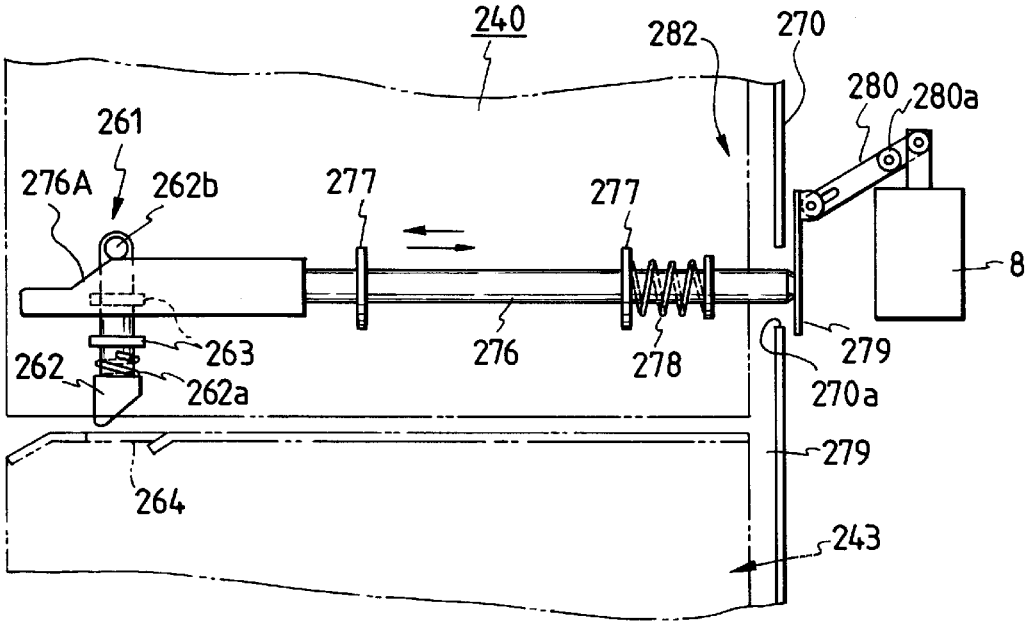
FIGS. 26A and 26B are longitudinal side sectional views showing a unit lock mechanism for locking a plurality of units to each other.
Figure 26B:
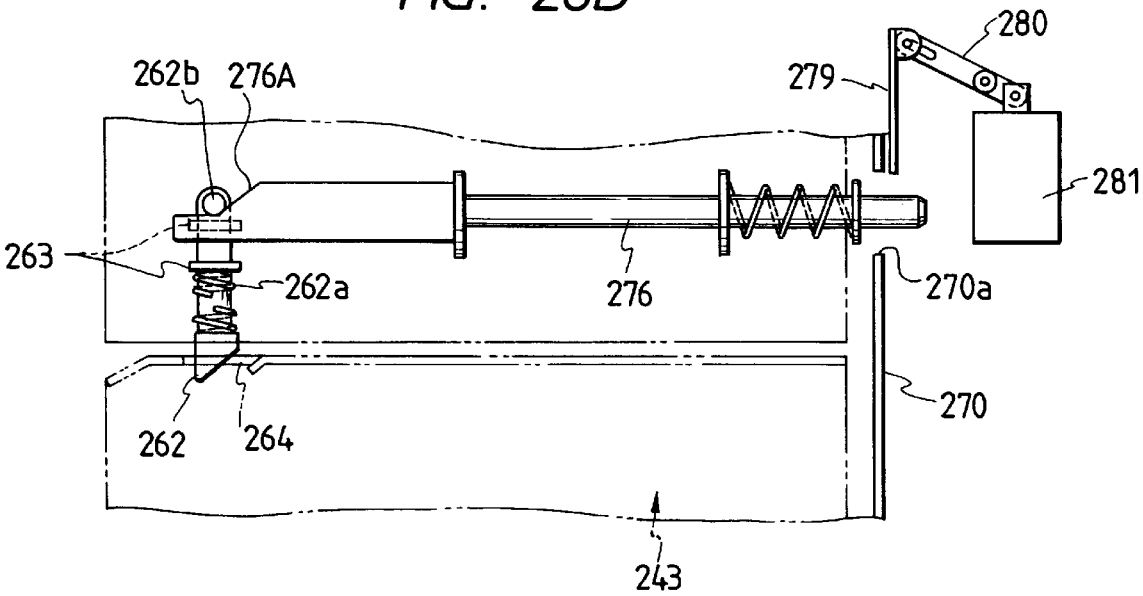

FIGS. 26A and 26B show a construction of a unit lock mechanism 261 for locking the part unit 240 and the both-face unit 242. In the part unit 240, a vertically extending unit lock pin 262 is supported by a pair of pin support 263 for sliding movement in an up-and-down direction. The unit lock pin 262 is biased downwardly by a pin spring 26*a* to protrude downwardly from the part unit 240. An engagement hole 264 formed in the both-face unit 242 (intermediate tray 243) can receive the unit lock pin 262.

The part unit 240 is provided with a horizontal release shaft 276 for shifting the unit lock pin 262 in the up-and-down direction. The release shaft 276 is supported by a pair of shaft support plates 277 for sliding movement in directions shown by the arrows. The release shaft 276 is always biased toward a rear side plate 270 by a shaft spring 278. Further, a cam surface 276A formed on a free end of the release shaft 276 is contacted with a pin roller 262*b* of the unit lock pin 262.

A rear end of the release shaft 276 is protruded from a hole 270*a* formed in the rear side plate 270 and is abutted against a stopper 279 supported for movement in an up-and-down direction. In this condition, as shown in FIG. 26A, since the pin roller 262*b* of the unit lock pin 262 is contacted with a higher profile of the cam surface 276A, the unit lock pin 262 is retarded into the part unit 240 to disengage from the engagement hole 264.

A free end of the stopper 279 is pivotally connected to one end of a lever 280 which can be rotated around a support pin 280*a* and the other end of which is pivotally connected to an operation member of a release solenoid 281. A release mechanism 282 for releasing a locking condition of the unit lock pin 262 is constituted by the release solenoid 281, lever 280, stopper 279, release shaft 276 and the like.

When the sheet detection sensor 239 detects the fact that the sheet is jammed in the first joint path portion 241 between the part unit 240 and the both-face unit 242 (while straddling between these units 240, 242), the release solenoid 281 is operated to lift the stopper 279 as shown in FIG. 26B, thereby releasing the release shaft 276. Consequently, the release shaft 276 is shifted to further protrude from the hole 270*a*, with the result that, as shown in FIG. 26B, the unit lock pin 262 is lowered to enter into the engagement hole 264 of the both-face unit 242, thereby interlocking the units 240, 242 to each other. Incidentally, the detection of the sheet jam is effected in such a manner that, when the sheet detection sensor 239 continues to detect the presence of the sheet for a predetermined time period, a control circuit (not shown) judges that the sheet jam occurs.

In this condition, when the part unit 240 is retracted from the machine body 202, the both-face unit 242 integrally connected to the part unit is also retracted. Thus, both units 240, 242 can be retracted without tearing the jammed sheet straddling between these units 240, 242.

After the sheet P jammed in the part unit 240 is removed, when the part unit 240 is inserted into the machine body 202, an inclined end surface of the unit lock pin 262 is pushed up by the engagement hole 264. As a result, the part unit 240 is unlocked from the both-face unit 242. Accordingly, only the part unit 240 can be inserted into the machine body 202 and the both-face unit 242 is maintained in the retracted condition. Therefore, the sheet jammed in the both-face unit 242 can easily be removed.

Figure 27A:
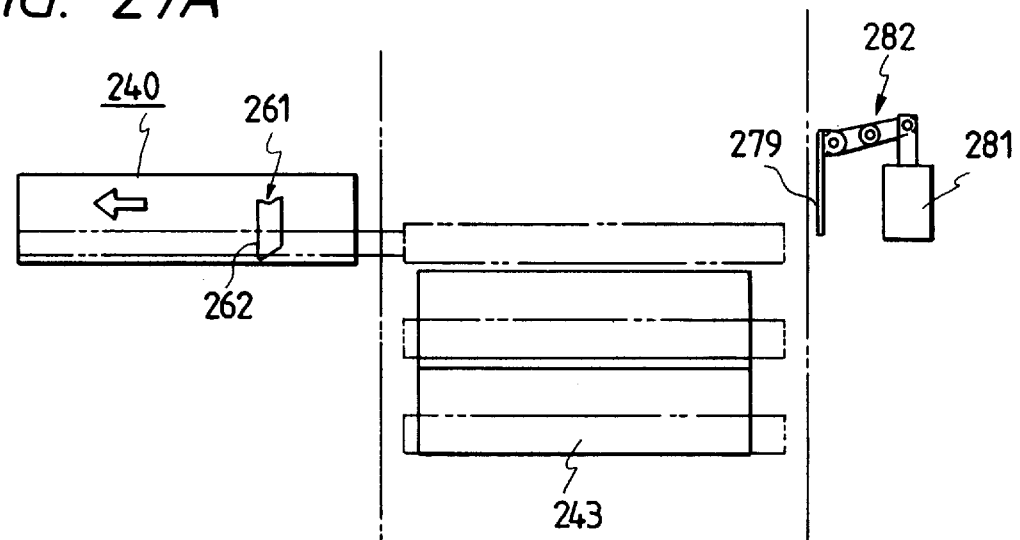
FIGS. 27A and 27B are longitudinal side sectional views showing a condition that a plurality of units are retracted.
Figure 27B:
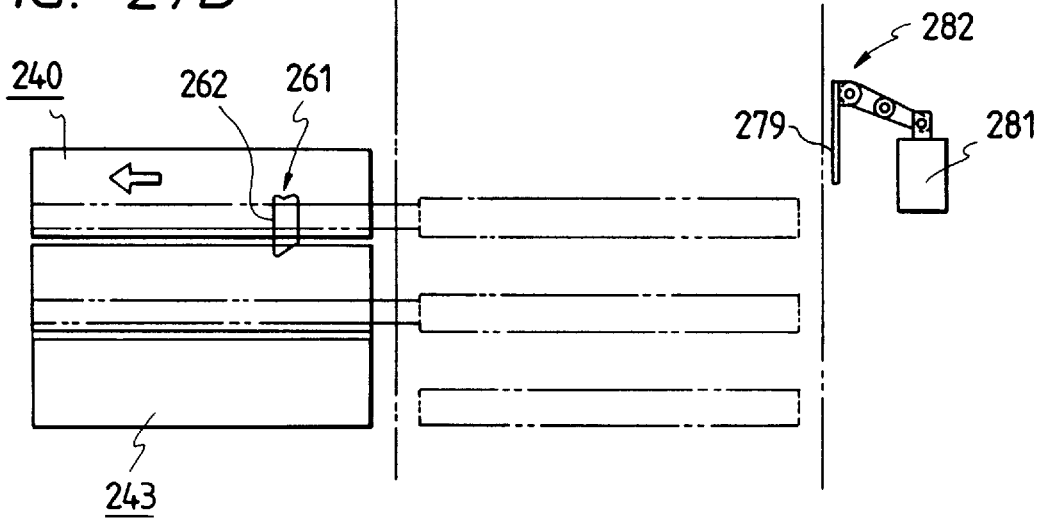

Incidentally, after a detection means (not shown) detects the fact that the part unit 240 and the both-face unit 242 have been retracted, when the release solenoid is turned OFF, the stopper 279 is returned to the original position shown in FIG. 26A. As a result, in the condition that the part unit 240 is accommodated in the machine body 202, the unit lock pin 262 is kept in the unlocked condition by the release mechanism 282, and, accordingly, after jam treatment, even when the both-face unit 242 is accommodated in the machine body 202, the unlocked condition between the units 240 and 242 is maintained (FIG. 26A). FIG. 27A shows a condition that the part unit 240 has been retracted from the machine body 202 when the sheet is not jammed in the first joint path portion 241. In this case, since the unit lock mechanism 261 is not operated, the part unit 240 can be retracted individually. Further, FIG. 27B shows a condition that the part unit 240 has been retracted from the machine body 202 after the sheet was jammed in the first joint path portion 241. In this case, as mentioned above, the unit lock mechanism 261 is operated to interlock the part unit 240 and the both-face unit 242. Accordingly, when the part unit 240 is retracted from the machine body 202, the both-face unit 242 is also retracted, thereby preventing the jammed sheet from tearing due to the relative movement between the part unit 240 and the both-face unit 242.

Figure 28A:
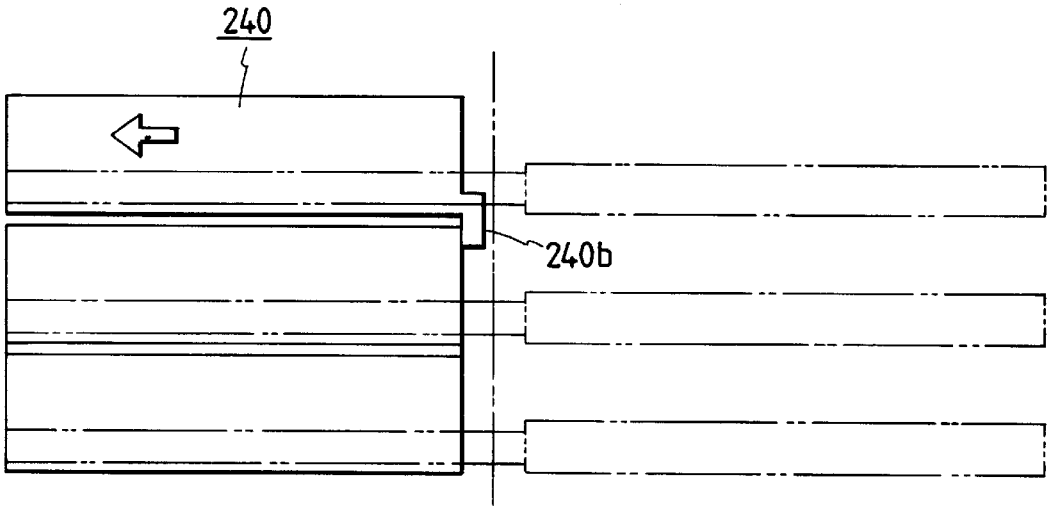
FIGS. 28A and 28B are longitudinal side sectional views showing another example that the plurality of units are integrally retracted.
Figure 28B:
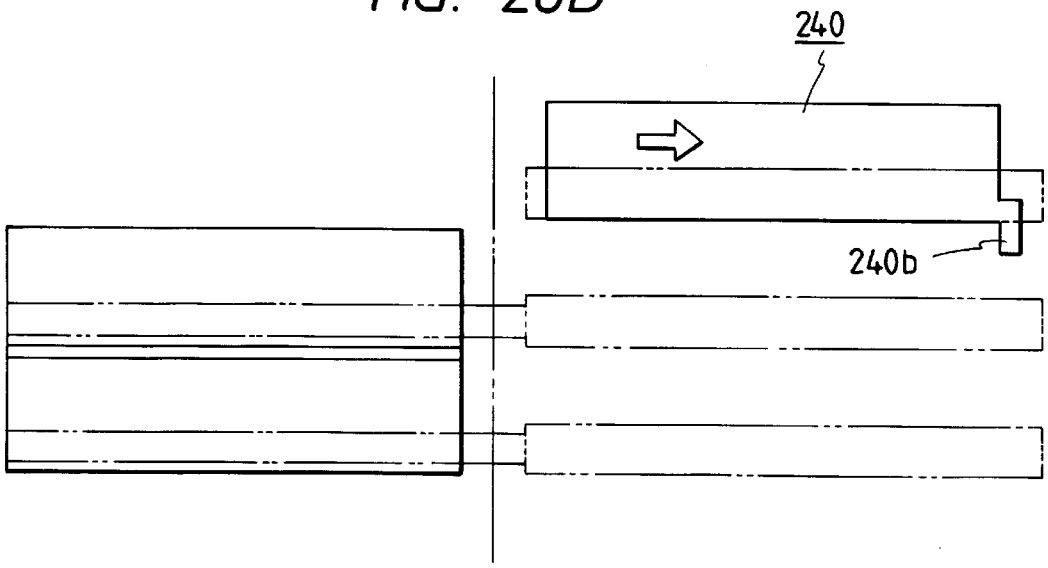

FIGS. 28A and 28B show an example that the part unit 240 and the both-face unit 242 are integrally shifted without using a lock mechanism.

When the fact that the sheet is jammed in the first joint path portion 241 is displayed on the display means (not shown), the part unit 240 is retracted in a direction shown by the arrow. An engagement tongue 240*b* is formed on the rear portion of the part unit 240 so that, when the part unit 240 is retracted, the lower both-face unit 242 can be retracted together with the part unit. After the jam treatment, when the part unit 240 is inserted into the machine body 202, as shown in FIG. 28B, the both-face unit 242 is maintained in the retracted condition, thereby facilitating the jam treatment regarding the both-face unit 242.

Next, a second embodiment of the present invention will be explained with reference to FIG. 29.

Figure 29:
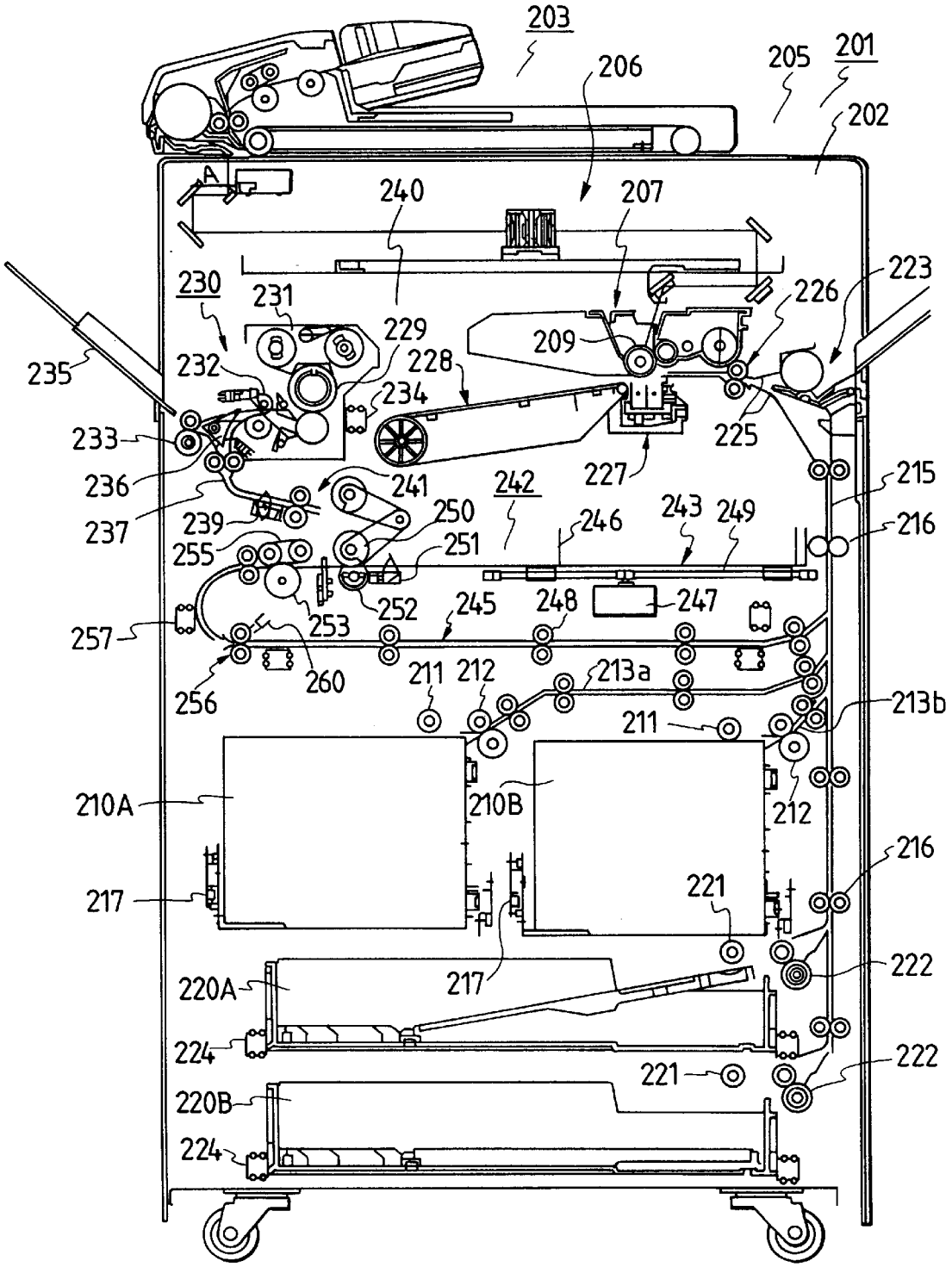
FIG. 29 is a longitudinal side sectional view showing a second embodiment of the present invention.

In a copying machine 201 shown in FIG. 29, the intermediate tray 243 constituting the both-face unit 242 and the both-face convey portion 245 can be retracted from the machine body 202 independently and are of front loading type, respectively. The both-face convey portion 245 is slidably supported by guide rails 283 so that the both-face convey portion can be retracted out of the machine body 202.

A second joint path portion 256 for delivering the sheet is disposed between the sheet path of the intermediate tray 243 and the sheet path of the both-face convey portion 245, and a second sheet detection means 260 for detecting the sheet is arranged in the proximity of the second joint path portion. Further, the first sheet detection means 239 for detecting the sheet is disposed in the sheet path between the part unit 240 and the intermediate tray 243. If the detection means 239 or 260 detects the presence of the sheet for a predetermined time period or more, it is judged that the sheet is jammed in the first joint path portion 241 or the second joint path portion 256. Since the other arrangement is the same as that shown in FIG. 22, the explanation thereof will be omitted.

Figure 31A:
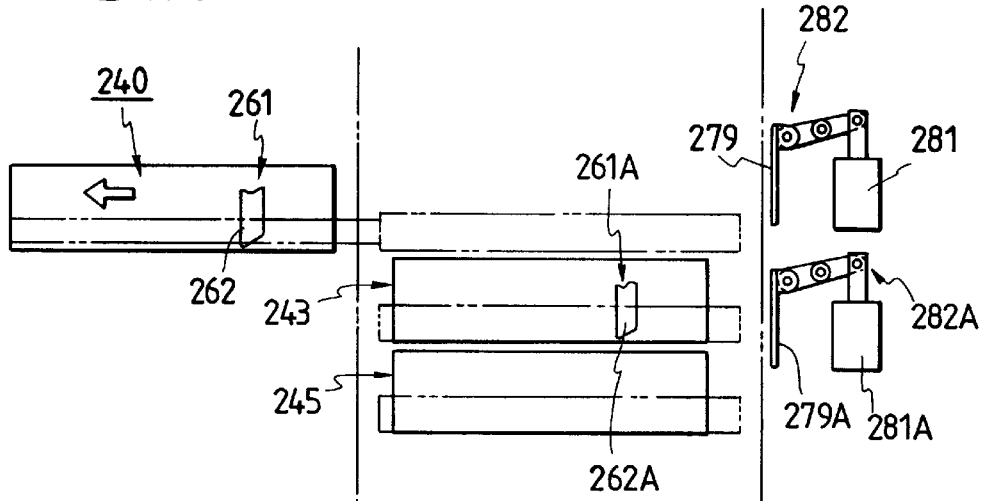
FIGS. 31A and 31B are explanatory views showing a condition that a plurality of units are retracted.
Figure 31B:
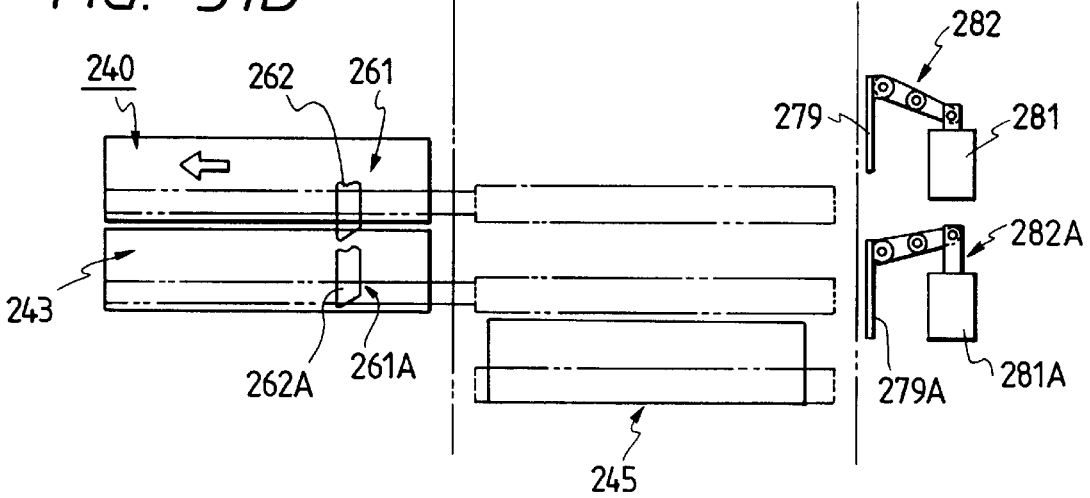

If the sheet is jammed in the first joint path portion 241, the part unit 240 and the intermediate tray 243 are interlocked to each other by a first unit lock mechanism 261 same as the unit lock mechanism 261 of the first embodiment (FIG. 31B). Further, when the part unit 240 is inserted into the machine body 202, the intermediate tray 243 is maintained in the retracted condition and the locking condition of the first unit lock mechanism 261 is released by the release mechanism 282 as in the first embodiment. On the other hand, if the sheet is jammed in the second joint path portion 256 and the jam condition is detected by the second detection means 260, a solenoid 281A is operated to lift a stopper 279A. As a result, a unit lock pin 262A is engaged by the both-face convey portion 245, so that the units 243, 245 are interlocked to each other by a second unit lock mechanism 261A.

Incidentally, FIG. 31A shows a condition that the sheet is not jammed in the first joint path portion 241 and the second joint path portion 256. In this case, the units 240, 243, 245 can be retracted from the machine body 202 independently and selectively.

Figure 30:
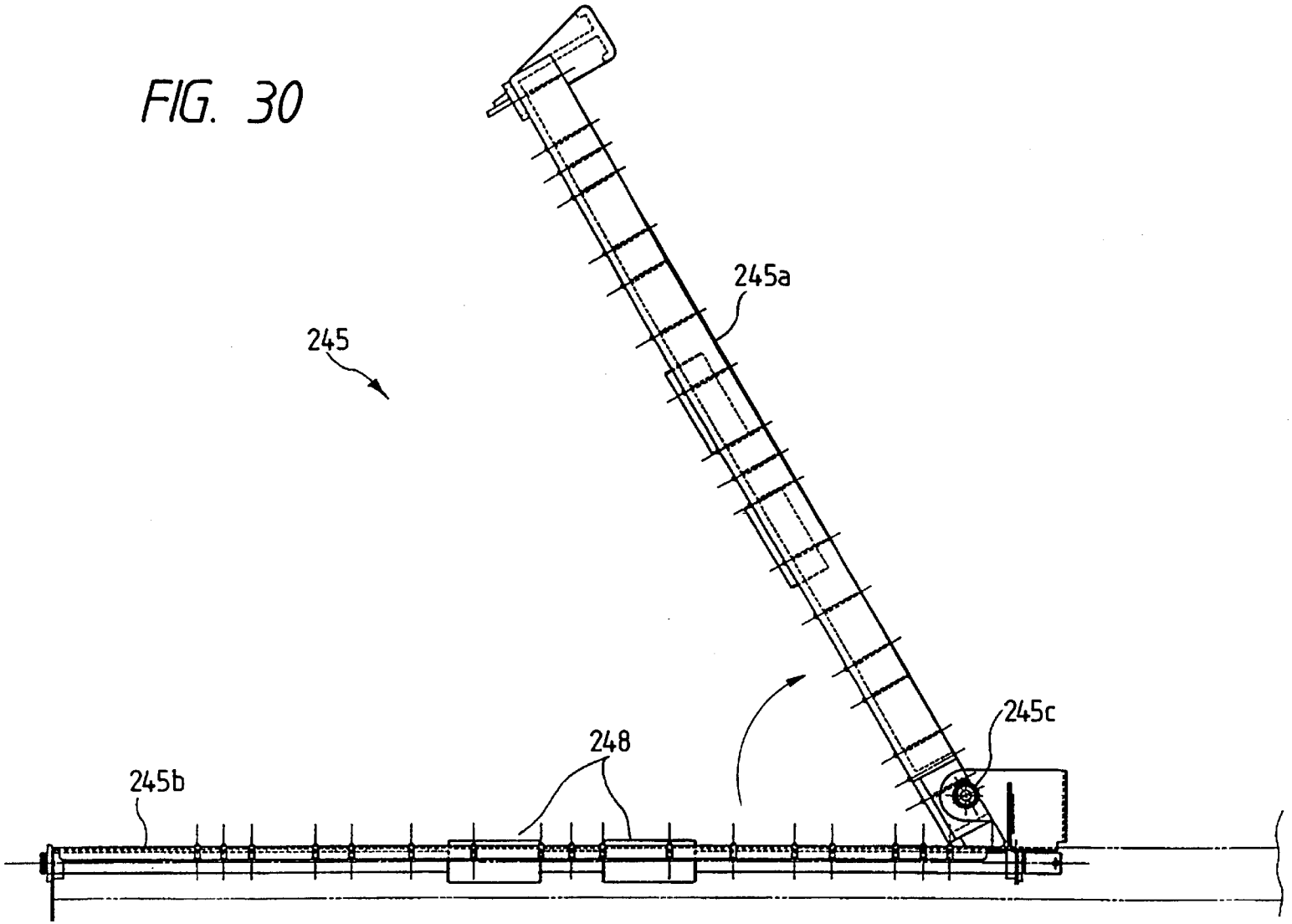
FIG. 30 is a side view showing a condition that a both-face convey portion is opened.

As shown in FIG. 30, the both-face convey portion 245 comprises a lower guide plate 245*b* having convey rollers 248, and an upper guide plate 245*a* pivotally connected to the lower guide plate via a support shaft 245*c*. If the sheet is jammed in the second joint path portion 256, when the intermediate tray 243 is retracted, the both-face convey portion 245 integrally connected to the tray is also retracted from the machine body. Then, the movable portion 243*a* of the intermediate tray 243 is opened and then the jam treatment is effected. Thereafter, when the intermediate tray 243 is inserted into the machine body, the both-face convey portion 245 is maintained in the retracted condition. In this condition, by opening the upper guide plate 245*a* of the both-face convey portion 245 in a direction shown by arrow as shown in FIG. 30, the jammed sheet can easily be removed.

Figure 32A:
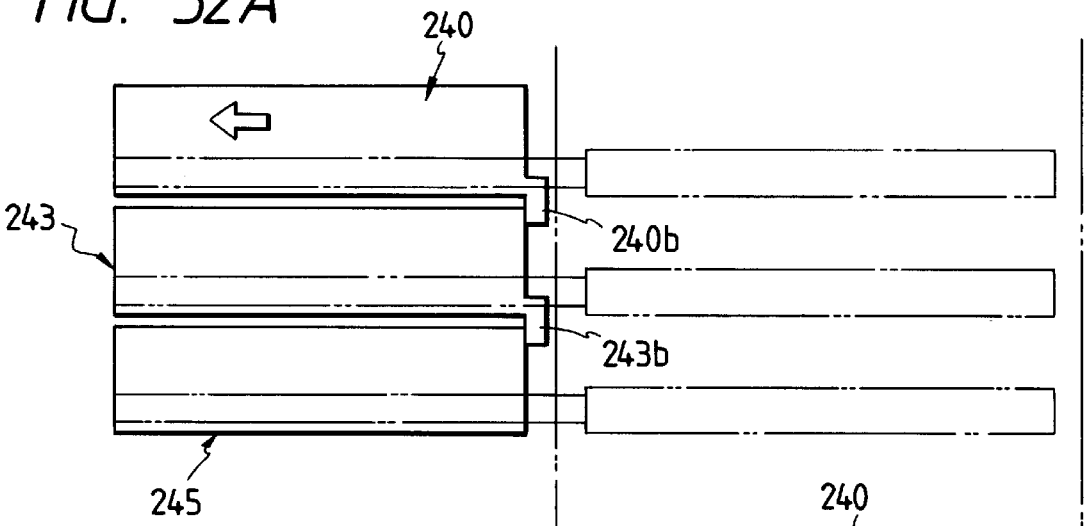
FIGS. 32A to 32C are longitudinal side sectional views showing another example that the plurality of units are integrally retracted.
Figure 32B:
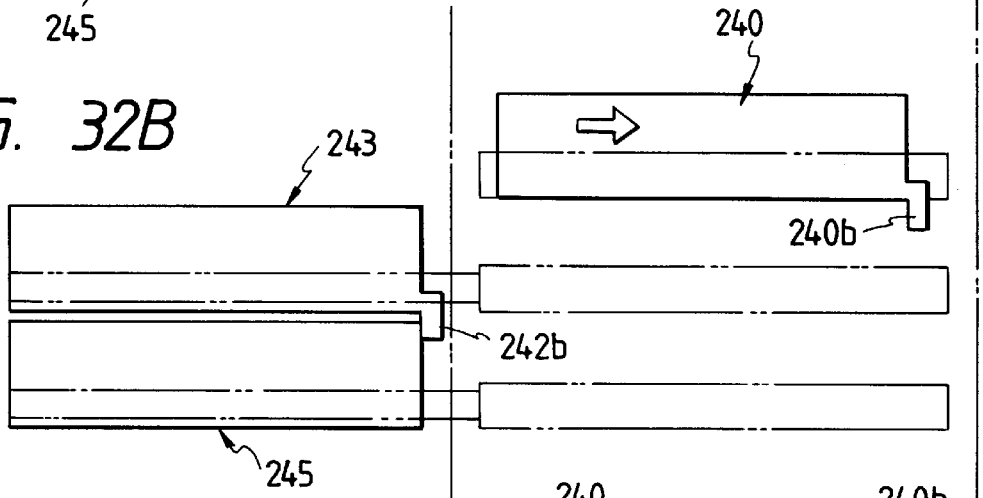
Figure 32C:
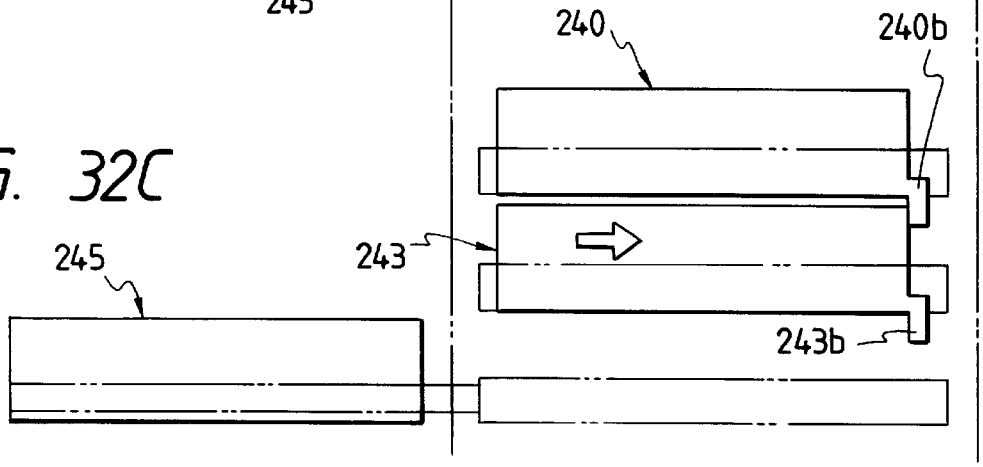

FIGS. 32A to 32C show an example that the units 240, 243, 245 can be retracted simultaneously without using special unit lock mechanisms such as the unit lock mechanisms 261, 261A. An engagement tongue 240*b* capable of engaging by the intermediate tray 243 is formed on the rear portion of the part unit 240, and an engagement tongue 243*b* capable of engaging by the both-face convey portion 245 is formed on the rear portion of the intermediate tray 243.

If the sheet is jammed in the first joint path portion 241, as shown in FIG. 32A, by retracting the part unit 240 in a direction shown by the arrow, the intermediate tray 243 and the both-face convey portion 245 are also retracted simultaneously in the same direction. After the jam treatment, as shown in FIG. 32B, when the part unit 240 is inserted into the machine body 202 (FIG. 22), the lower intermediate tray 243 and both-face convey portion 245 are maintained in the retracted condition. In this condition, the jam treatment regarding the intermediate tray 243 can easily be performed without tearing the jammed sheet.

On the other hand, if the sheet is jammed in the second joint path portion 256, by retracting the intermediate tray 243, the both-face convey portion 245 is also retracted from the machine body. After the jam treatment regarding the intermediate tray 243 is performed, when the intermediated tray is inserted into the machine body 202, the both-face convey portion 245 is maintained in the retracted condition. Thus, the jam treatment regarding the both-face convey portion 245 can also be performed easily.

In this way, if the sheets are jammed in the plural units, by retracting only the units in which the sheets are jammed, the jam treatment can easily be performed. On the other hand, if the sheets are jammed while straddling between the plural units, after the plural units in which the sheets are jammed are retracted, since the jammed sheet can be removed per each unit, the jam treatment can easily be performed without tearing the sheets.

Incidentally, by providing sheet detection sensors associated with adjacent units, it may be judged that the sheet is jammed while straddling between these units when both sensors detect the presence of the sheet.

Figure 33:
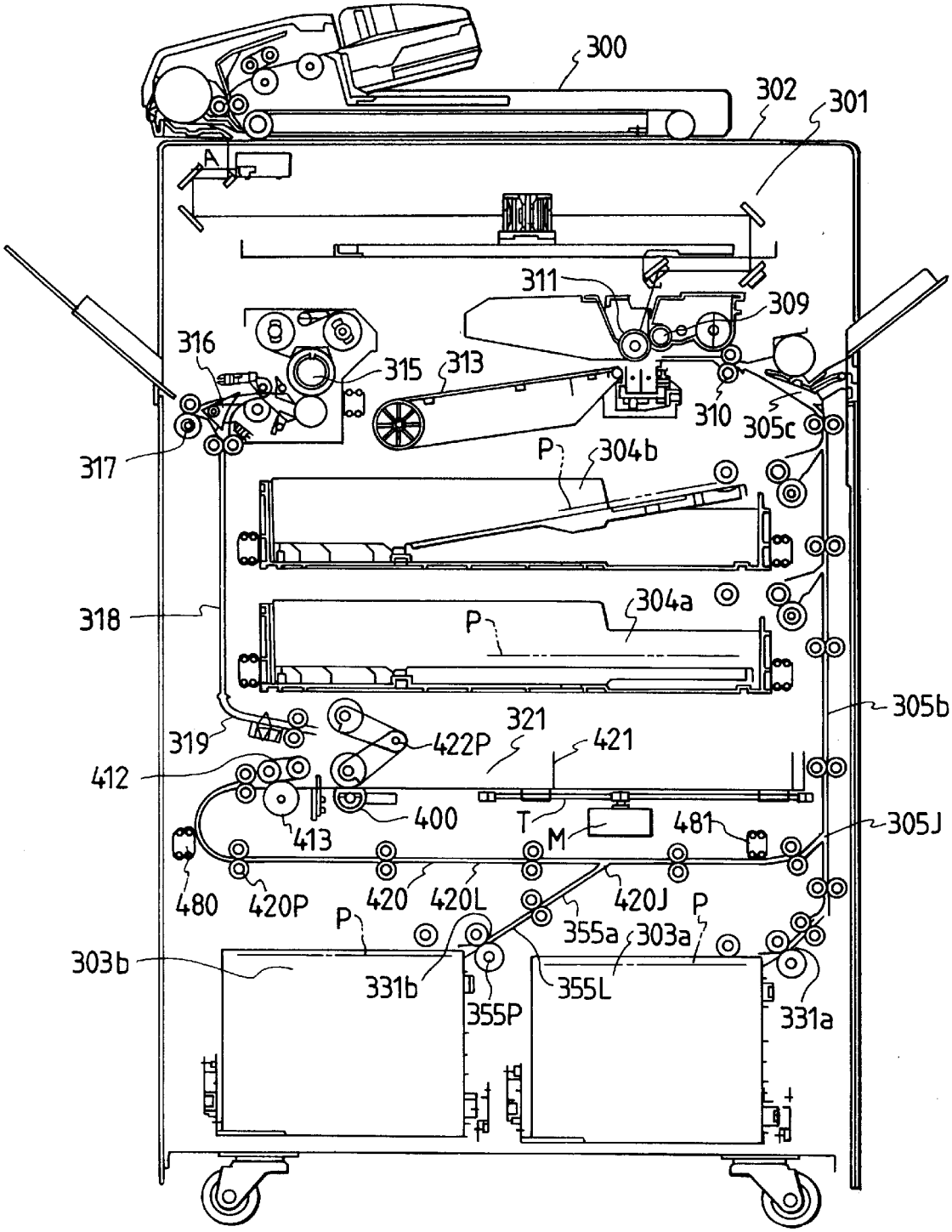
FIG. 33 is a longitudinal side sectional view showing a first embodiment according to a fifth invention.

FIG. 33 shows an embodiment of a fifth invention.

Within a body 302 of an image forming apparatus 301 according to this embodiment, deck cases 303*a*, 303*b* each capable of containing one thousand (1000) sheets of small size (for example, A4 size) (having high frequency of use) are arranged side by side at a lower portion of the apparatus.

If FIG. 33, the sheets in the right deck case 303a are supplied and separated one by one by a sheet supply portion 331*a*, and the separated sheet is directed to a regist introduction path 305*b*. The sheets in the left (FIG. 33) deck case 303*b* are supplied and separated one by one by a sheet supply portion 331*b*, and the separated sheet is directed to the regist introduction path 305*b* through a delivery path 305*a*. The sheet from the regist introduction path 305*b* passes through an introduction path 305*c* and then is sent to an image forming portion 311 by a pair of regist rollers 310.

The sheet on which an image was formed in the image forming portion 311 passes through a convey portion 313 to reach a fixing device 315 for fixing a toner image to the sheet. A pair of sheet discharge rollers 317 are arranged at a downstream side of the fixing device 315.

Between the fixing device 315 and the paired discharge rollers 317, there is provided a reverse rotation flapper 316 for reversing the sheet on one surface of which the image was formed. In the both-face copy mode, the sheet is directed to a path 318 by the flapper 316, thereby discharging the sheet onto an intermediate tray unit 321. This intermediate tray unit is of a so-called "lower separation type" wherein the sheets stacked on the tray are supplied and separated one by one from the lowermost one. The re-supplied (separated) sheet passes through a re-supply convey path 420 to reach a junction 305bJ (between the path 420 and the regist introduction path 305*b* from the deck cases), from which the sheet is introduced into the regist introduction path 305*b*. Thereafter, an image is formed on a second surface of the sheet in the same manner as the first surface of the sheet.

Further, cassettes 30*a*, 304*b* each capable of containing five hundreds (500) sheets of large size (for example, A3 size) or of small size (for example, A4 size) are arranged above the intermediate tray unit 321 in an overlapped condition.

Incidentally, the cassettes 304*a*, 304*b*, the deck cases 303*a*, 303*b* and the intermediate tray 321 can be retracted out of the body 302 of the image forming apparatus at its front side. As mentioned above, a plurality of deck cases (sheet containing means) 303*a*, 303*b* each capable of one thousand (1000) sheets P are arranged side by side (right and left in FIG. 33) at the lowermost portion of the body 302 of the image forming apparatus 301, which decks are communicated with the regist introduction path 305*b*.

By scanning an original supplied one by one from an automatic original supply device 300 by means of an optical system, a latent image is formed in the image forming portion 311, which latent image is developed as a toner image. The sheet P on which the toner image was formed in the image forming portion 311 is sent to the fixing device 315, where the toner image is fixed to the sheet.

In the multi copy or the both-face copy modes, after the fixing, the sheets are directed to the paths 318, 319 and then are discharged onto the intermediate tray unit 321, where trailing ends of the sheets are aligned by a regulating plate 421. The regulating plate 421 can be shifted by a reversible belt T driven by a motor M in the left and right direction.

The sheets P stacked on the intermediate tray unit 321 are fed out by a feed-out roller 400 and a hold-down roller pivoted around a support shaft 422P and are supplied one by one to the re-supply convey path 420 by a sheet re-supply means comprising a convey roller 413 and a separation belt 412.

The sheet P conveyed in the re-supply convey path 420 is sent to the regist introduction path 305*b* through the junction 305bJ to reach the regist rollers 310. A lower path guide 420L of the re-supply convey path 420 can be pivoted around a fulcrum 420P so that the sheet P jammed in the re-supply convey path 420 can be removed.

The sheet P supplied from the deck case 303*b* remote from the regist introduction path 305*b* (among the plurality of deck cases 303*a*, 303*b* arranged below and in the proximity of the re-supply convey path 420) is conveyed through a convey path 355*a*. A lower path guide 355L of the convey path 355*a* can be pivoted around a fulcrum 355P so that the jammed sheet P can be removed. The convey path 355*a* is connected to an intermediate portion of the re-supply convey path 420 via a junction 420J. Accordingly, a path portion between of the re-supply convey path 420 between the junction 420J and the junction 305*aJ* is used as both a re-supply path and a deck path. Incidentally, the intermediate tray unit 321 and the re-supply convey path 420 can be retracted from the body 302 of the apparatus at its front side along guide rails 480, 481.

As mentioned above, by joining the convey path 355*a* to the re-supply convey path 420, the convey path 213*a* as shown in FIG. 22 can be omitted, with the result that the jam space between the re-supply convey path 420 and the deck cases 330*a*, 330*b* is increased, thereby facilitating the jam treatment and reducing the height of the body 302 of the apparatus.

Figure 34:
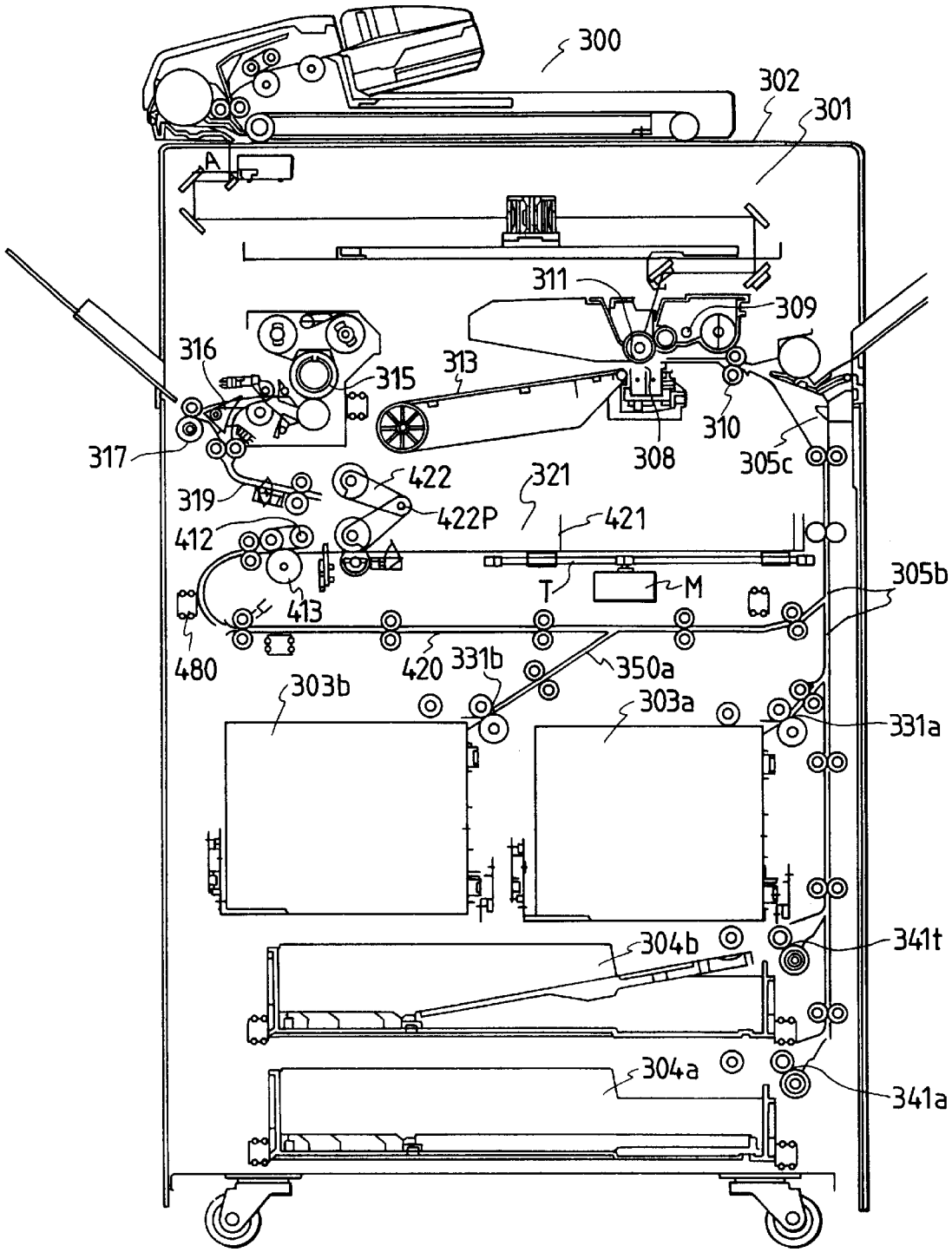
FIG. 34 is a longitudinal side sectional view showing a second embodiment according to the fifth invention.

Next, a second embodiment of the fifth invention will be explained with reference to FIG. 34.

In this embodiment, the arrangement in which the deck cases 303*a*, 303*b* are arranged below and in the proximity of the intermediate tray unit 321 is the same as the embodiment of FIG. 33. However, in this embodiment, the intermediate tray unit 321 is disposed below and in the proximity of the image forming portion 311. By arranging the intermediate tray unit 321 associated with the deck cases 330*a*, 330*b* below and in the proximity of the image forming portion 311 as mentioned above, it is possible to shorten the paths for sending the plurality of sheets P to the image forming portion 311, thereby improving the efficiency of the image formation.

Next, an embodiment of a sixth invention will be explained with reference to the accompanying drawings.

Figure 35:
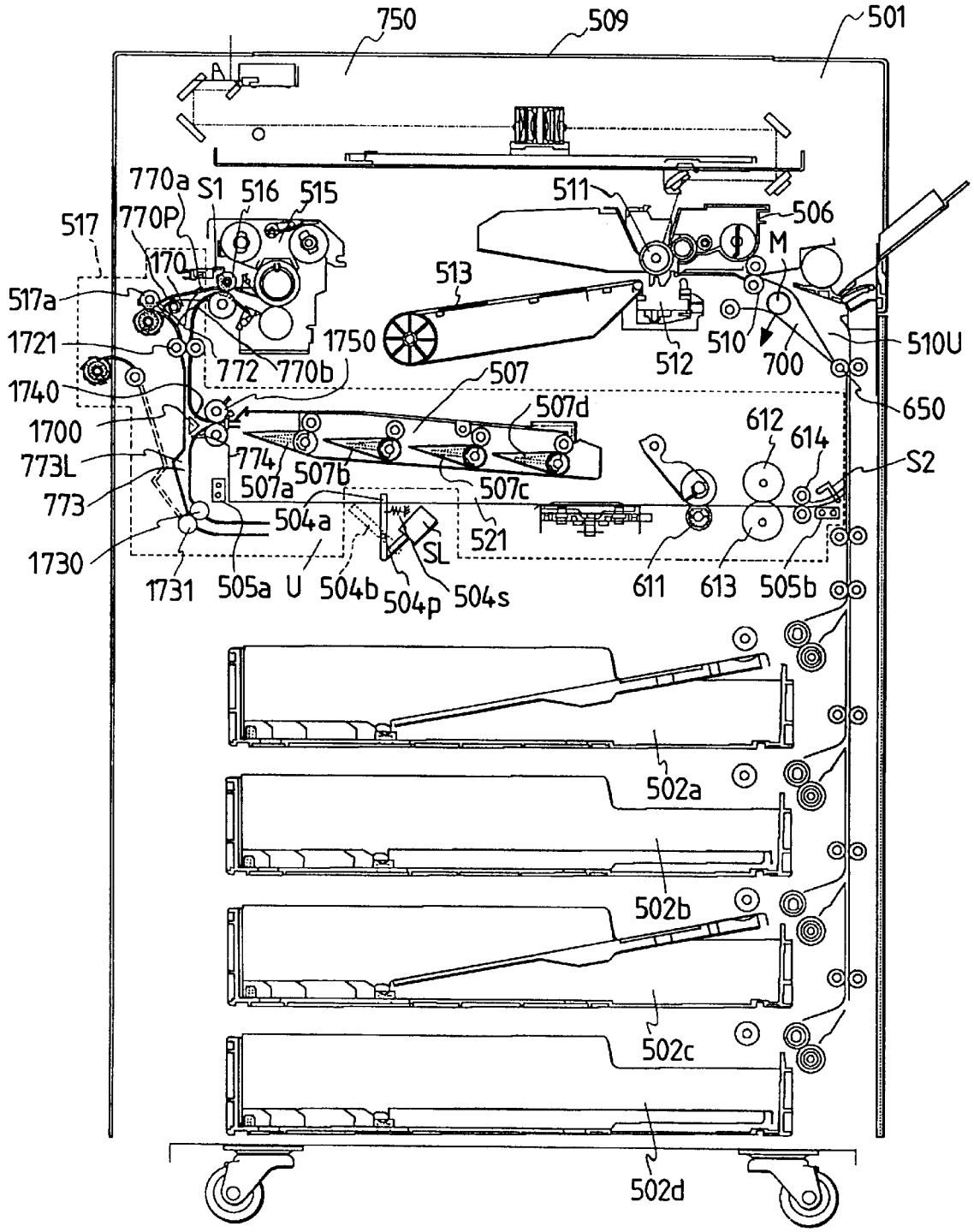
FIG. 35 is a longitudinal sectional view showing a first embodiment (image forming apparatus) according to a sixth invention.

In FIG. 35, in a copying machine (image forming apparatus) according to this embodiment, cassettes 502*a*, 502*b*, 502*c* and 502*d* of front loading type are arranged as a sheet supply means at a lower portion of the machine.

The image forming apparatus 1 includes an optical system 750 for scanning an original rested on an original support 509, a photosensitive drum 511 on which a toner image is formed by the exposure by means of the optical system 705 and the development by means of a developing device 506, a transfer portion 512 for transferring the toner image onto a sheet, a fixing device 515 for fixing the toner image to the sheet, and a both-face unit U.

In this embodiment, the both-face unit U (shown by a block encircled by the broken line) includes a sheet discharge portion 517, a reverse rotation portion 773, an intermediate tray 521, and re-supply portion 611, 612 and 613 and can be retracted from the image forming apparatus at its front side. That is to say, movable portions of accuride rails 505*a*, 50*b* are attached to the both-face unit U (within the broken line block) and fixed portions of the rails are attached to a body 501 of the image forming apparatus, so that the both-face unit can smoothly be retracted from the apparatus.

In the both-face copy mode, a path switching flapper 770 is rotated around a fulcrum 770*p* to a position 770*a* so that the sheet can be introduced into a path 772. Further, by a path switching flapper 1700, the sheet is directed to a switch-back portion 773. When a sensor (not shown) disposed in the proximity of the flapper detects the fact that the sheet has passed through the sensor, rollers 1730, 1731 are rotated reversely to direct the sheet to a path 774 and a both-face convey path 507. In the both-face convey path, there are provided gates 507*a*, 507*b*, 507*c* and 507*d* which are switched in dependence upon the size of the sheet so that the sheet is discharged on the intermediate tray 521.

In the multi copy mode, the sheet introduced to the path 772 by the path switching flapper 770 is directed to a path 1740 by the path switching flapper 1700 to reach the both-face convey path 507.

Since the sheet sent from the sheet supply cassette to the intermediate tray 521 travels a long convey path, in many cases, the sheet is skew-fed. Further, since the sheet is skew-fed when it is rested on the intermediate tray 521, the orientation and position of the sheet on the intermediate tray 521 are dispersed (laterally with respect to a longitudinal direction (advancing direction of the sheet)). Accordingly, the sheets are stacked on the intermediate tray 521 scatteringly, and, therefore, if the sheets are re-supplied as they are, the skew-feed of the sheet, poor sheet feeding and/or sheet jam will occur. Further, particularly in the multi copy mode, if the lateral position of the re-supplied sheet is deviated from the correct position, the superimposed image will be deviated from the previously copied image (lateral registration deviation).

In order to avoid this, a regulating side plate (not shown) shifted by a driving force of a motor and the like is arranged on the intermediate tray 521 so that both lateral edges of the sheets stacked on the intermediate tray 521 are regulated by the regulating side plate, thereby correcting the orientation and lateral position of each sheet (widthwise correction). Further, a semi-circular sheet supply roller 611 is associated with the intermediate tray 521, and a sheet re-supply roller 613 and a separation roller 612 are associated with the sheet re-supply portion so that several lower sheets on the intermediate tray 521 are shifted along a sheet guide (not shown) by one or two revolutions of the semi-circular sheet supply roller 611 to enter into a nip between the sheet re-supply roller 613 and the separation roller 612. Then, the sheets are separated one by one from the lowermost one by the rotations of the sheet re-supply roller 613 and the separation roller 612, and the separated sheet is re-supplied to the image forming portion 511.

In the single-face copy mode, if the sheet is jammed, when a sensor S1 detects the fact that the sheet is jammed while straddling between the fixing convey roller 516 of the fixing unit and the sheet discharge portion 517, the both-face unit U is locked so that it cannot be retracted this side. That is to say, in FIG. 35, in the copying operation, since the lock lever is in a position 504*p* and is biased toward a clockwise direction by a spring 504*s*, the both-face unit cannot be retracted this side. In this condition, the fixing convey roller 516 and discharge convey rollers 1721 are driven to positively discharge the sheet straddling between the fixing convey roller 516 and the discharge convey rollers 1721 onto a discharge tray (not shown).

Similarly, in the multi copy mode, if the sheet is jammed, when the sensor S1 detects the fact that the sheet is jammed while straddling between the fixing convey roller 516 and the discharge path 772 or a sensor S2 detects the fact that the sheet is jammed while straddling between drawing rollers 614 and convey rollers 650 of the machine, the both-face unit U is locked so that it cannot be retracted this side. In this condition, the fixing convey roller 516 and the convey rollers 1721 are rotated while stopping the convey roller 1731. Since the switch-back portion 773 has a curved portion 773L, the sheet jammed while straddling between the fixing portion and the discharge portion is retarded into the curved portion 773L. Similarly, the sheet jammed while straddling between the drawing rollers 614 and the convey rollers 650 of the machine is retarded into a curved portion 510U by rotating the drawing rollers 614 and the convey rollers 650 while stopping the regist rollers 510.

After the above-mentioned operation is finished, the solenoid is turned ON to rotate the lock lever around a fulcrum 504*p* to the position 504*b* in opposition to the tension spring 504*s*. In this condition, the both-face unit U can be retracted.

The discharge side path guides of the discharge portion and the switch-back portion 773 are pivotally supported on a roller shaft of the convey roller 1731 so that the path guides can be rocked outwardly. With this arrangement, the jam treatment regarding the both-face unit can easily be performed after the both-face unit is retracted this side and the path guides of the discharge portion and the switch-back portion are rocked toward the discharge side.

The sheet jammed in the both-face convey portion 507 can be removed from this side, and the sheets jammed in the intermediate tray and the re-supply portion can be removed from the above.

A pre-regist guide 700 is pivotally supported on a roller shaft of the convey roller 650 so that it can be rocked in a direction shown by the arrow M. Thus, the sheet retarded to the curved portion 510U can be removed after the pre-regist guide 700 is rocked.

Figure 36:
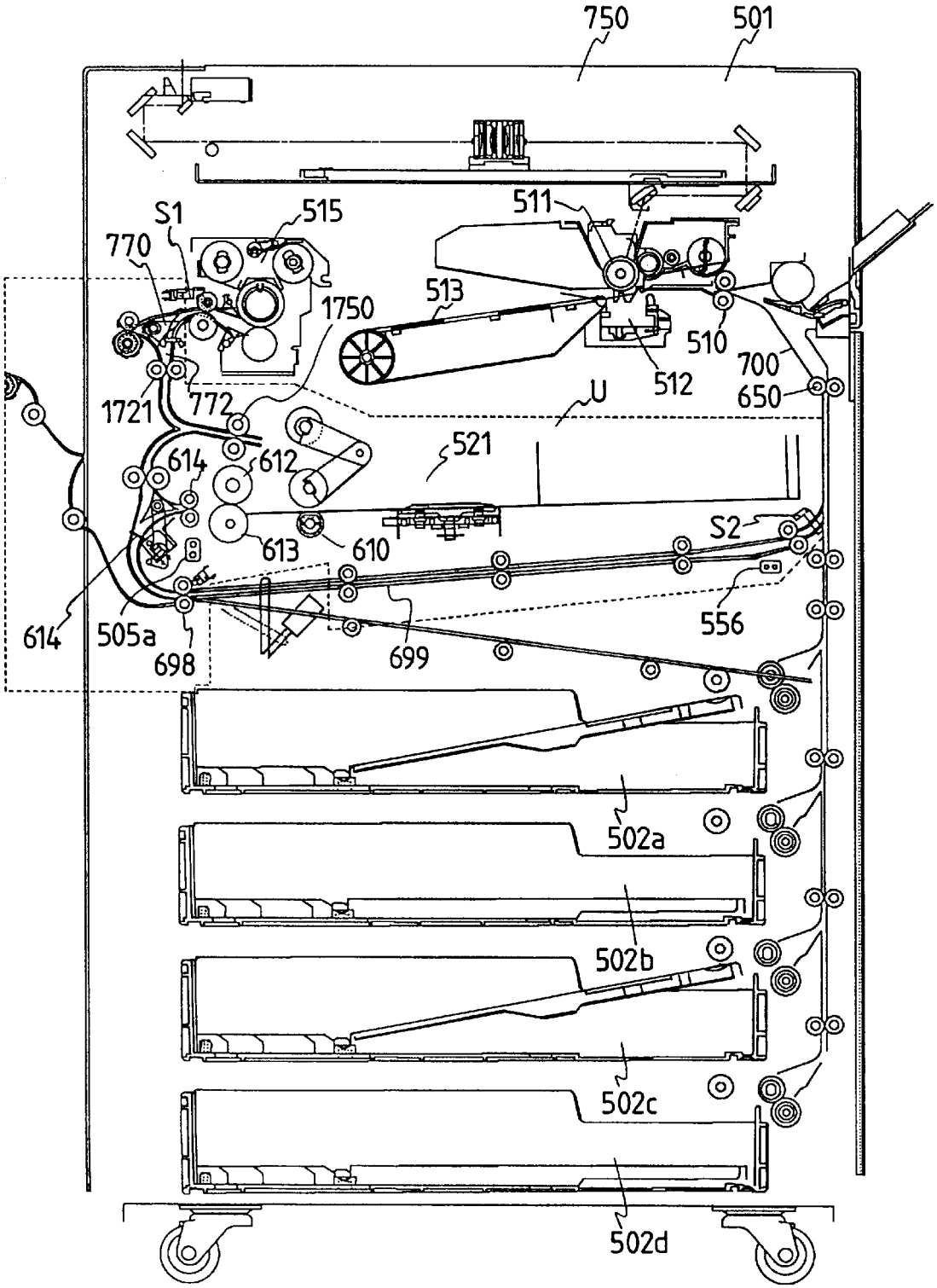
FIG. 36 is a longitudinal sectional view showing a second embodiment according to the sixth invention.
Figure 37:
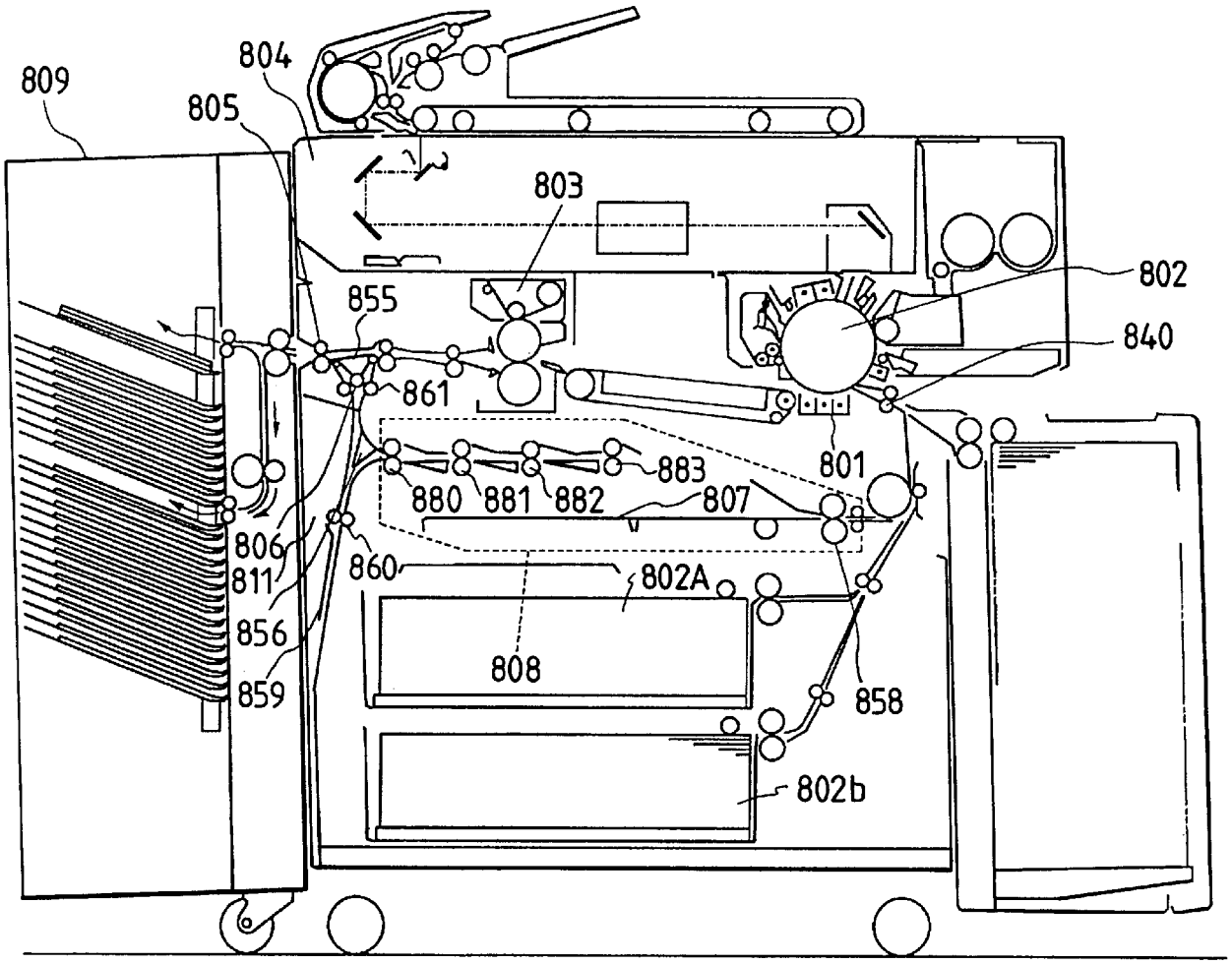
FIG. 37 is a longitudinal side sectional view showing an example of a conventional image forming apparatus.
Figure 38:
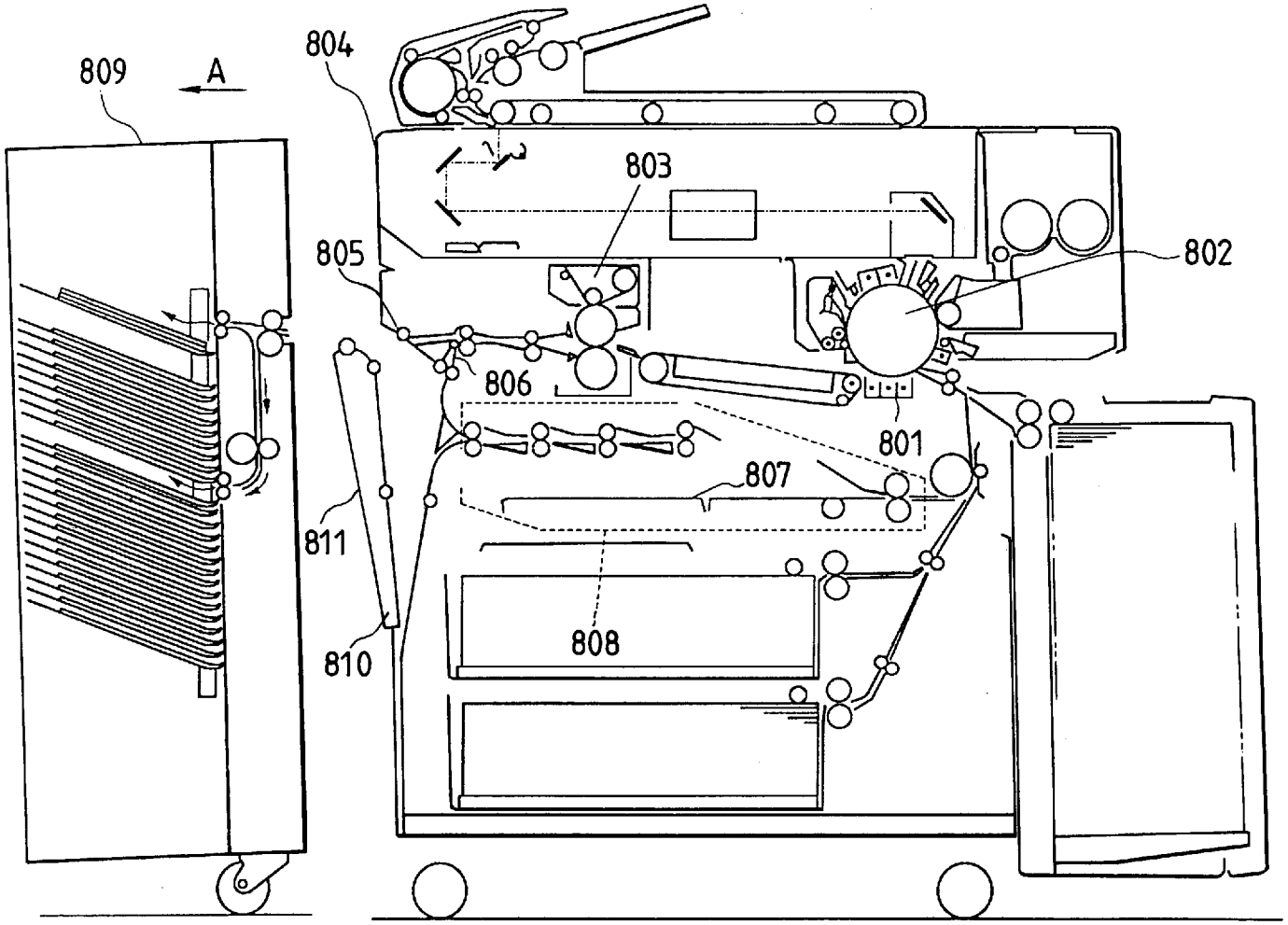
FIG. 38 is a longitudinal side sectional view showing the jam treatment in the conventional image forming apparatus.

The other embodiment will be explained with reference to FIG. 36.

In this embodiment, since there is no both-face convey portion, unlike to the embodiment of FIG. 35, a more simplified and cheaper both-face unit can be provided.

In the both-face copy mode, the sheet from the fixing portion passes through the path 772 and the convey rollers 1721, 1750 and is discharged onto the intermediate tray 521. The sheets on the intermediate tray are separated one by one from the lowermost one by the re-supply portion, and the separated sheet is drawn by the drawing rollers 614 to direct to a circulating path 699 and is sent to the image forming portion 511. The circulating path 699 is pivotally supported on a roller shaft of a convey roller 698 so that it can be rocked downwardly around the roller shaft. Thus, the sheet jammed in the circulating path can easily be removed.

What is claimed is:

1. An image forming apparatus, comprising:

image forming means for forming an image on a sheet;

discharge means for discharging a sheet from the image forming apparatus;

a convey path for guiding the sheet;

switching means for selectively introducing the sheet on which the image was formed by the image forming means to said discharge means or said convey path; and support means for supporting said discharge means, said convey path and said switching means as a unit drawable in a substantially horizontal direction intersecting with the discharging direction of said discharge means.

2. An image forming apparatus according to claim 1, further comprising an openable guide member for opening said convey path.

3. An image forming apparatus according to claim 1, further comprising detection means for detecting the fact that the sheet is jammed, and control means for controlling so that, said detection means detects the fact that the sheet is jammed while passing through said discharge means or said switching means, the sheet continues to be conveyed until the sheet passes by said discharge means or said switching means.

4. An image forming apparatus according to claim 1, wherein said convey path is provided with a space for containing the jammed sheet.

5. An image forming apparatus according to claim 1, further comprising second detection means for detecting the fact that the sheet is jammed and the jammed sheet is held by both of said unit and the image forming apparatus, and control means for regulating the drawing of said unit on the basis of the detection of said second detection means.

6. An image forming apparatus, comprising:

image forming means for forming an image on a sheet;

fixing means for fixing a toner image formed by said image forming means to the sheet;

discharge means for discharging the sheet to which the toner image was fixed by said fixing means out of the image forming apparatus;

reverse rotation means for reversing or turning up the sheet to which the toner image was fixed by said fixing means; and support means for supporting at least said fixing means, said discharge means and said reverse rotation means as an integral unit which can be shifted in a substantially horizontal direction intersecting a discharging direction of said discharge means.

7. An image forming apparatus according to claim 6, wherein said unit integrally includes a reverse rotation means for reversing or turning up the sheet to which the toner image was fixed by said fixing means.

8. A sheet conveying apparatus, comprising:

first guide means for guiding a sheet being conveyed;

second guide means connected to said first guide means and adapted to guide the sheet the sheet guided by said first guide means;

first support means for supporting said first guide means for shifting movement from a predetermined guide position toward a direction intersecting with a conveying direction;

second support means for supporting said second guide means for shifting movement from a predetermined guide position toward the direction intersecting with the conveying direction; and connecting means for connecting said first guide means and said second guide means to each other in such a manner that, when one of said first and second guide means is shifted from said predetermined guide position, the other guide means is simultaneously shifted from its predetermined guide position.

9. A sheet conveying apparatus according to claim 8, wherein a connecting condition of said connecting means is released when said first and second guide means are in their predetermined guide position, respectively.

10. A sheet conveying apparatus according to claim 9, further comprising lock means for locking said first guide means in its predetermined guide position.

11. A sheet conveying apparatus according to claim 8, wherein said connecting means connects said first guide means to said second guide means when both said first and second guide means are in their predetermined guide position and when said first and second guide means are shifted.

12. A sheet conveying apparatus according to claim 8, further comprising release means for releasing a connecting condition of said connecting means.

13. A sheet conveying apparatus according to claim 12, further comprising detection means for detecting the fact that the sheet is jammed and the jammed sheet is held by both of said first guide means and said second guide means, and wherein, when said detection means does not detect the fact that the sheet is jammed while between said first guide means and said second guide means, said release means releases the connecting condition of said connecting means.

14. A sheet conveying apparatus according to claim 12, wherein said release means has a solenoid.

15. A sheet conveying apparatus according to claim 8, wherein said connecting means selectively connects said first guide means and said second guide means to each other.

16. A sheet conveying apparatus according to claim 15, further comprising detection means for detecting the fact that the sheet is jammed and the jammed sheet is held by both of said first guide means and said second guide means.

17. A sheet conveying apparatus according to claim 16, wherein when said detection means detects the fact that the sheet is jammed and the jammed sheet is held by both of said first guide means and said second guide means, said connecting means connects said first guide means and said second guide means to each other.

18. An image forming apparatus, comprising:

image forming means for forming an image on a sheet;

first containing means for containing a plurality of sheets;

second containing means disposed lateral to said first containing means for containing a plurality of sheets, said first containing means and said second containing means arranged adjacent to each other;

a first convey path for directing the sheet from said first containing means to said image forming means;

a second convey path disposed above said first and said second containing means and below said image forming means, said second convey path extending substantially horizontally and joining said first convey path at a first join point for directing the sheet on which the image was formed by said image forming means to said image forming means again via the first join point and said first convey path;

switchback means disposed between said image forming means and said second convey path for reversing an advancing direction of the sheet; and a third convey path joining to said second convey path at a second join point upstream of the first join point on said second convey path in a conveying direction of the sheet for directing the sheet from said second containing means to said image forming means via the second join point, said second convey path and said first convey path.

19. An image forming apparatus according to claim 18, wherein a third containing means is arranged between said image forming means and said second convey path.

20. An image forming apparatus according to claim 18, wherein at least one of said first and second containing means is supported for shifting movement in a substantially horizontal direction intersecting with a sheet discharge direction.

21. An image forming apparatus, comprising:

image forming means for forming a toner image on a sheet;

regist roller means for sending a sheet to said image forming means in registration with the timing of image formation;

fixing means for fixing a toner image formed by said image forming means to the sheet;

discharge means for discharging the sheet on which the toner image was fixed by said fixing means out of the image forming apparatus;

convey path means for directing the sheet on which the toner image was fixed by said fixing means to said image forming means again;

switching means for selectively guiding the sheet on which the toner image was fixed by said fixing means to said discharge means or said convey path means;

a first support means for supporting at least one of said image forming means, said regist roller means, said fixing means, said discharge means and said switching means as a first integral unit which can be shifted in a substantially horizontal direction intersecting with a discharging direction of said discharge means;

a second support means for supporting at least a portion of said convey path means as a second unit which can be shifted in a substantially horizontal direction intersecting with the discharging direction of said discharge means; and connecting means for connecting said first and second units to each other in such a manner that, when said first or second unit is shifted, the other unit is also retracted simultaneously.

22. An image forming apparatus, comprising:

image forming means for forming an image on a sheet;

first guide means for guiding the sheet on which the image was formed by said image forming means;

second guide means connected to said first guide means and adapted to guide the sheet guided by said first guide means;

first support means for supporting said first guide means for shifting movement from a predetermined guide position toward a direction intersecting with a conveying direction;

second support means for supporting said second guide means for shifting movement from a predetermined guide position toward the direction intersecting with the conveying direction; and connecting means for connecting said first guide means and said second guide means to each other in such a manner that, when said first or second guide means is shifted from said predetermined guide position, the other guide means is simultaneously shifted from its predetermined guide position.

23. A sheet conveying apparatus according to claim 22, wherein said connecting means selectively connects said first guide means and said second guide means to each other.

24. A sheet conveying apparatus according to claim 23, further comprising detection means for detecting the fact that the sheet is jammed and the jammed sheet is held by both of said first guide means and said second guide means.

25. A sheet conveying apparatus according to claim 24, wherein when said detection means detects the fact that the sheet is jammed and the jammed sheet is held by both of said first guide means and said second guide means, said connecting means connects said first guide means and said second guide means to each other.

* * * * *

UNITED STATES PATENT AND TRADEMARK OFFICE

CERTIFICATE OF CORRECTION

PATENT NO. : 5,854,965 Page 1 of 3

DATED : December 29, 1998

INVENTOR(S) : AKIHIRO KASIWABARA, ET AL.

It is certified that error appears in the above-identified patent and that said Letters Patent is hereby corrected as shown below:

COVER PAGE [56],
U.S. Patent Documents, "5,258,817" should read --5,258,818--.

COVER PAGE [57] ABSTRACT,
Line 4, "path" should read --paths--; and
Line 9, "sheets)" should read --sheet)--.

COLUMN 2,
Line 23, "sheets)" should read --sheet)--; and
Line 58, "by" should read --be--.

COLUMN 6,
Line 3, "invention" should read --inventions--; and
Line 4, "embodiment" should read --embodiments--.

COLUMN 7,
Line 43, "straddling" should read --spanning--;
Line 46, "straddling" should read --spanning--;
Line 49, "straddling" should read --spanning--; and
Line 63, "straddling" should read --spanning--.

UNITED STATES PATENT AND TRADEMARK OFFICE

CERTIFICATE OF CORRECTION

PATENT NO. : 5,854,965

DATED : December 29, 1998

INVENTOR(S) : AKIHIRO KASIWABARA, ET AL.

It is certified that error appears in the above-identified patent and that said Letters Patent is hereby corrected as shown below:

COLUMN 10,
Line 14, "270," should be deleted;
Line 45, "In case" should read --In the case--;
Line 46, "straddling" should read --spanning--;
Line 59, "straddling" should read --spanning--; and
Line 64, "straddling" should read --spanning--.

COLUMN 12,
Line 7, "straddling" should read --spanning--.

COLUMN 14,
Line 6, "unit" should read --units--;
Line 15, "straddling" should read --spanning--; and
Line 31, "straddling" should read --spanning--.

COLUMN 16,
Line 37, "26a" should read --262a--.

COLUMN 17,
Line 2, "straddling" should read --spanning--; and
Line 18, "straddling" should read --spanning--.

COLUMN 19,
Line 26, "straddling" should read --spanning--; .

UNITED STATES PATENT AND TRADEMARK OFFICE

CERTIFICATE OF CORRECTION

PATENT NO. : 5,854,965 Page 3 of 3

DATED : December 29, 1998

INVENTOR(S) : AKIHIRO KASIWABARA, ET AL.

It is certified that error appears in the above-identified patent and that said Letters Patent is hereby corrected as shown below:

COLUMN 19
Line 33, "straddling" should read --spanning--; and
Line 41, "If" should read --In--.

COLUMN 20,
Line 55, "between" (first occurrence) should be deleted.

COLUMN 22,
Line 25, "straddling" should read --spanning--;
Line 33, "straddling" should read --spanning--;
Line 38, "straddling" should read --spanning--;
Line 40, "straddling" should read --spanning--;
Line 46, "straddling" should read --spanning--; and
Line 49, "straddling" should read --spanning--.

COLUMN 24,
Line 13, "the sheet" (second occurrence) should be deleted.

Signed and Sealed this

Twenty-seventh Day of July, 1999

*Attest:*

Q. TODD DICKINSON

*Attesting Officer* *Acting Commissioner of Patents and Trademarks*